US008522478B1

(12) United States Patent
Blachley

(10) Patent No.: US 8,522,478 B1
(45) Date of Patent: Sep. 3, 2013

(54) READY TO ASSEMBLE SHUTTER

(76) Inventor: David Blachley, Newport Beach, CA (US)

( * ) Notice: Subject to any disclaimer, the term of this patent is extended or adjusted under 35 U.S.C. 154(b) by 2377 days.

(21) Appl. No.: 11/079,535

(22) Filed: Mar. 12, 2005

Related U.S. Application Data

(60) Provisional application No. 60/552,547, filed on Mar. 13, 2004.

(51) Int. Cl.
*E05F 15/20* (2006.01)

(52) U.S. Cl.
USPC ..... 49/74.1

(58) Field of Classification Search
USPC ..... 49/74.1, 87.1, 506
See application file for complete search history.

(56) References Cited

U.S. PATENT DOCUMENTS

| | | | |
|---|---|---|---|
| 1,639,474 | A | 8/1927 | Whitmore |
| 1,701,695 | A | 2/1929 | Paine |
| 2,091,012 | A | 8/1937 | Pratt |
| 3,180,246 | A | 4/1965 | Johnson |
| 3,324,785 | A | 6/1967 | Underdahl |
| 3,491,481 | A | 1/1970 | Wunderlick |
| 4,276,954 | A | 7/1981 | Romano |
| 4,380,857 | A | 4/1983 | Senuma et al. |
| 4,655,003 | A | 4/1987 | Henley, Sr. |
| 4,936,048 | A | 6/1990 | Ruggles |
| 5,020,276 | A | 6/1991 | Zittell |
| 5,121,785 | A | 6/1992 | Ohsumi |
| 5,191,735 | A | 3/1993 | Ross |
| 5,194,310 | A | 3/1993 | Lenderink |
| 5,216,837 | A | 6/1993 | Cleaver et al. |
| 5,379,551 | A | 1/1995 | Swapp |
| 5,392,561 | A | 2/1995 | Henley, Sr. |
| 5,469,658 | A | 11/1995 | Digianni et al. |
| 5,483,873 | A | 1/1996 | Koivukunnas et al. |
| 5,490,353 | A | 2/1996 | McLaughlin |
| 5,630,295 | A | 5/1997 | Neiman |
| 5,778,598 | A | 7/1998 | Ohanesian |
| 5,794,380 | A | 8/1998 | Guardia |
| 5,887,386 | A | 3/1999 | Alexanian et al. |
| 5,996,672 | A | 12/1999 | Kotin |
| 6,041,547 | A | 3/2000 | Marocco |
| 6,098,340 | A | 8/2000 | Francis |
| 6,125,906 | A | 10/2000 | Kotin |
| 6,145,251 | A | 11/2000 | Ricci |
| 6,192,964 | B1 | 2/2001 | Cianci |
| 6,219,985 | B1 | 4/2001 | Hsu |
| 6,314,680 | B1 | 11/2001 | Buckwalter et al. |
| 6,401,391 | B2 | 6/2002 | Gabriele |
| 6,467,219 | B1 | 10/2002 | Gardner |
| 6,536,162 | B2 | 3/2003 | LaMay |
| 6,622,433 | B2 | 9/2003 | Blachley |
| 6,655,091 | B1 | 12/2003 | Iwasaki |
| 6,675,534 | B2 | 1/2004 | Marocco |

(Continued)

*Primary Examiner* — Jerry Redman
(74) *Attorney, Agent, or Firm* — Law Office of Glenn R. Smith; Glenn R. Smith; Lisa L. Smith

(57) ABSTRACT

A shutter kit comprising frame components, louvers, inserts, louver clips and tilt bars are combined as a ready to assemble shutter. The frame components are configured to assemble into a shutter frame. The louvers are adapted to fit within the shutter frame. The inserts are adapted to attach to stiles of the frame components. The louver clips are capable of rotatably attaching at regular intervals along the length of the inserts and removably retaining the louvers. The tilt bars are adapted to rotatably interconnect the louver clips. In one embodiment, the inserts, louver clips and tilt bars are preassembled into trees adapted to insert into an assembled shutter frame.

11 Claims, 33 Drawing Sheets

(56) References Cited

U.S. PATENT DOCUMENTS

| | | | |
|---|---|---|---|
| 6,701,669 | B1 | 3/2004 | Yorgason |
| 6,732,475 | B1 | 5/2004 | Lee |
| 6,854,211 | B1 | 2/2005 | Blachley |
| 7,055,231 | B1 | 6/2006 | Blachley |
| 2001/0004004 | A1 | 6/2001 | Levy |
| 2002/0056231 | A1 | 5/2002 | Blachley |
| 2002/0062545 | A1 | 5/2002 | Niedermair |
| 2004/0140062 | A1 | 7/2004 | Lee |

DETAIL A

READY TO ASSEMBLE SHUTTER

CROSS-REFERENCE TO RELATED APPLICATIONS

This application relates to and claims the benefit of prior U.S. Provisional Application No. 60/552,547 entitled Full View Shutter, filed Mar. 13, 2004 and incorporated by reference herein.

BACKGROUND OF THE INVENTION

Shutters are a high quality interior window treatment, having a combination of style, functionality and elegance that sets them apart from other window coverings. Shutters provide warmth in the winter and protect from damaging heat and sunlight in the summer. Shutters also provide a convenient method of controlling view, privacy and light. Conventional shutters are typically custom made of an indigenous wood such as popular, oak or ash and are installed by professionals.

SUMMARY OF THE INVENTION

FIGS. 1-2 illustrate a conventional shutter window treatment 100 having a window frame 101 mounted around a window opening and a shutter 200 mounted within and hinged to the window frame 101, allowing the shutter 200 to swing open or closed. The shutter 200 has stiles 210, spreaders 220, louvers 230 and a tilt bar 240. The louvers 230 are rotatably mounted to the stiles 210 using standard louver pins 250. The tilt bar 240 is linked to the leading edge of the louvers 230 with an interlocked tilt bar link 260 and louver link 270 and operable up and down so as to rotate the louvers 230 to various positions. The louvers 230 have a closed position with the tilt bar 240 in a fully up position and the louvers 230 overlapping along the edges so as to block light from passing through the opening 204. The louvers 230 also have various open positions with the tilt bar 240 positioned away from the fully up position and the louvers 230 rotated away from the plane of the opening so as to allow light to pass.

Conventional shutters are assembled, pre-framed and hinged at a factory, boxed as fully assembled units, and transported to a job site. Typically, assembled shutters are professionally installed. As a result, conventional shutters are expensive, long-lead items for both assembly and installation.

Further, conventional shutters require tradeoffs with respect to viewing area. The stiles, spreaders and tilt bar block substantial areas of the window opening, reducing the viewing area and incoming light. The shutter can swing open on its hinges to increase the view, but this requires spreaders and stiles of sufficient dimension for mechanical strength and stability, contributing to the window blockage when the shutter is closed. The louver thickness, which is dictated by the use of louver pins for louver attachment, also reduces the viewing area.

In addition, conventional shutters do not provide perfect light control. The mechanical structure of conventional shutters only allows the louvers to close completely in one direction, up or down. Further, when the louvers are closed, light leakage occurs through the gap between the louvers and the stiles.

One aspect of a ready to assemble shutter is a shutter kit method providing frame components and louvers, the frame components being configured to assemble into a frame. Trees are assembled that are adapted to attach to the frame and are capable of removably and rotatably disposing the louvers within an opening of the frame. The frame components, trees and louvers are combined as a ready-to-assemble shutter. Tree assembly may comprise the steps of providing inserts adapted to insert into stiles of the frame components, rotatably attaching louver clips at regular intervals along the length of the inserts, and interconnecting at least a portion of the louver clips with at least one tilt bar. The interconnecting substep may comprise configuring leg portions of the tilt bars to fit into gaps between the frame and the louvers, and configuring cross bar portions of the tilt bars to fit across the gaps so as to block light from passing through the gaps.

Further steps of the shutter kit method may include determining window measurements and selecting the frame components and louvers, based upon the window measurements, from a frame component set and a louver set, where the frame component set comprises predetermined length stiles and predetermined length spreaders and where the louver set comprises predetermined length louvers. An additional step may be trimming the trees to a specific length based on at least one window measurement. Yet another step may be pre-inserting the trees into the stiles.

Another aspect of a ready to assemble shutter is a shutter kit comprising frame components, louvers, inserts, louver clips and tilt bars combined as a ready to assemble shutter. The frame components are configured to assemble into a shutter frame. The louvers are adapted to fit within the shutter frame. The inserts are adapted to attach to stiles of the frame components. The louver clips are capable of rotatably attaching at regular intervals along the length of the inserts and removably retaining the louvers. The tilt bars are adapted to rotatably interconnect the louver clips. In one embodiment, the inserts, louver clips and tilt bars are preassembled into trees adapted to insert into an assembled shutter frame. The shutter kit may further comprise light stop portions of the tilt bars adapted to block light between the assembled shutter frame and the louvers when the louvers are in a closed position. The frame components and louvers may be each selected from a set of frame components and louvers having predetermined lengths. The trees may be cut to a length corresponding to the assembled shutter frame and pre-inserted into stiles of the frame components.

DETAILED DESCRIPTION OF THE PREFERRED EMBODIMENTS

Full View Shutter

Figure 3A:
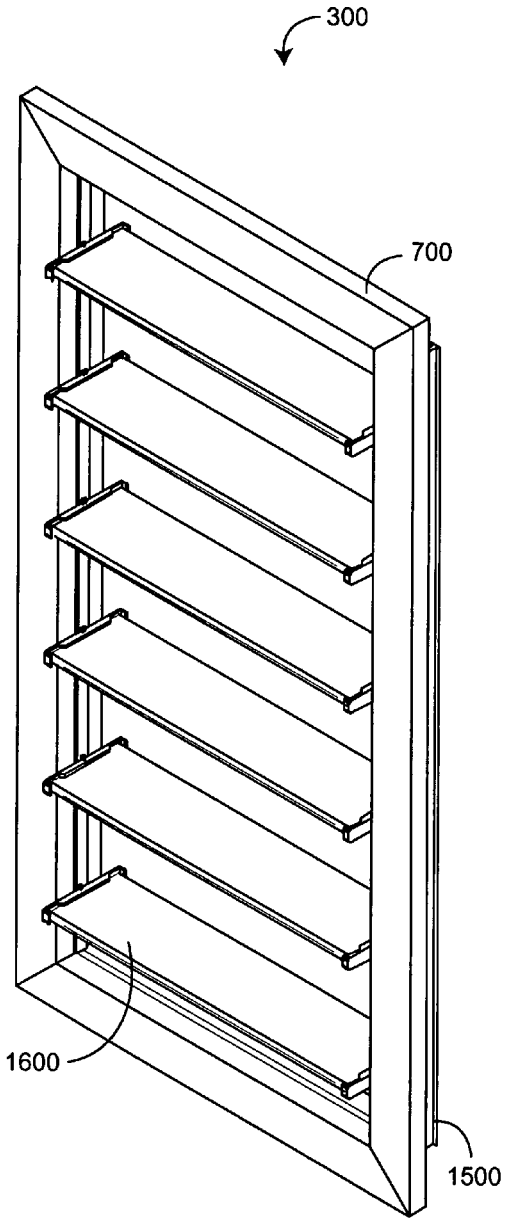
FIGS. 3A-D are front, back, exploded and partially exploded perspective views, respectively, of a full view shutter.
Figure 3B:
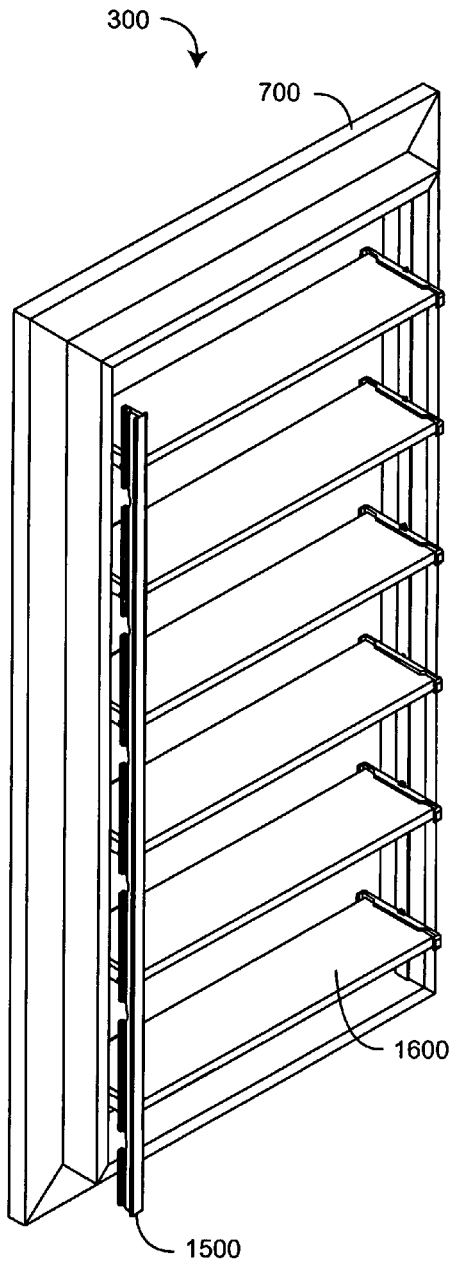
Figure 3C:
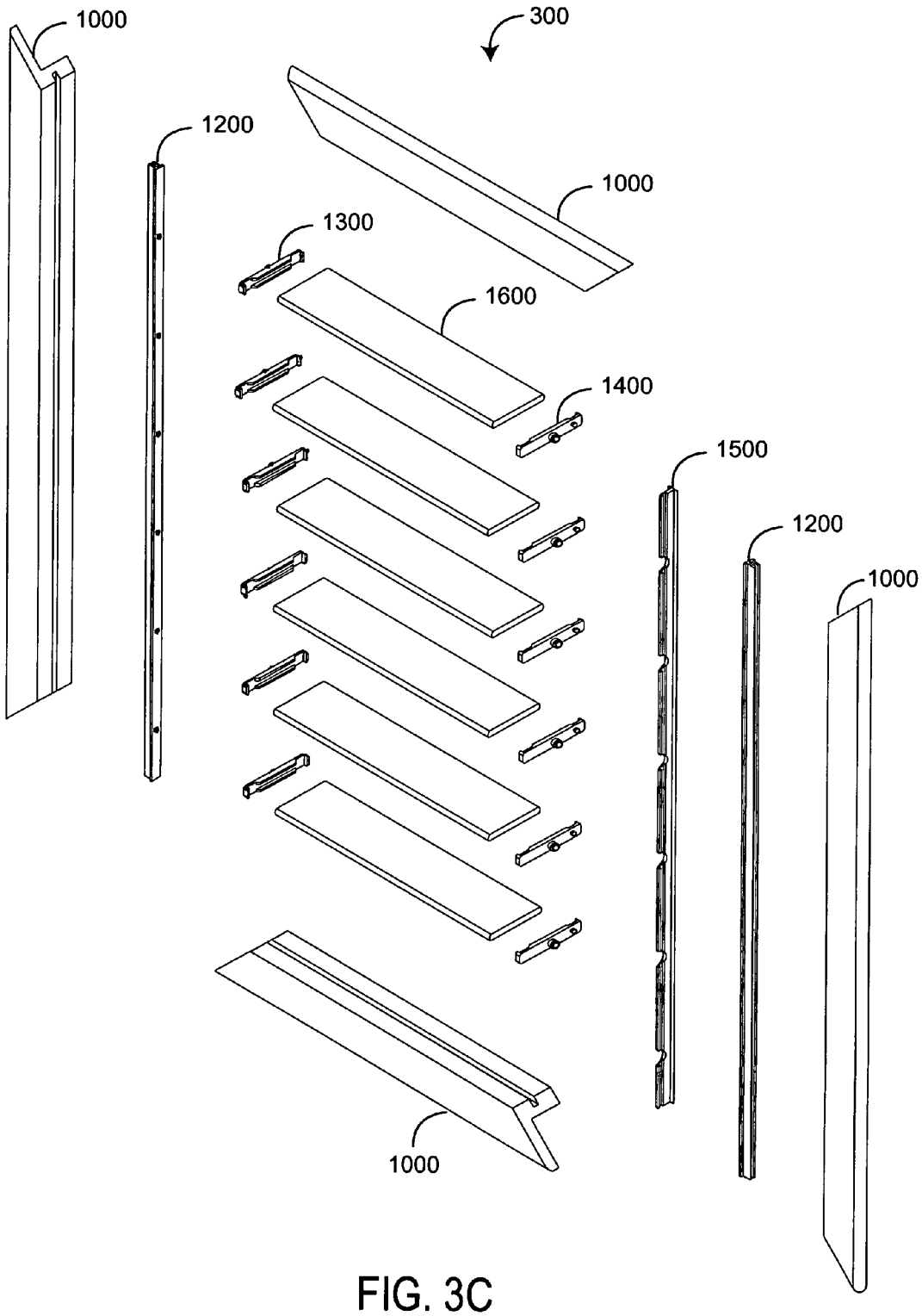
Figure 3D:
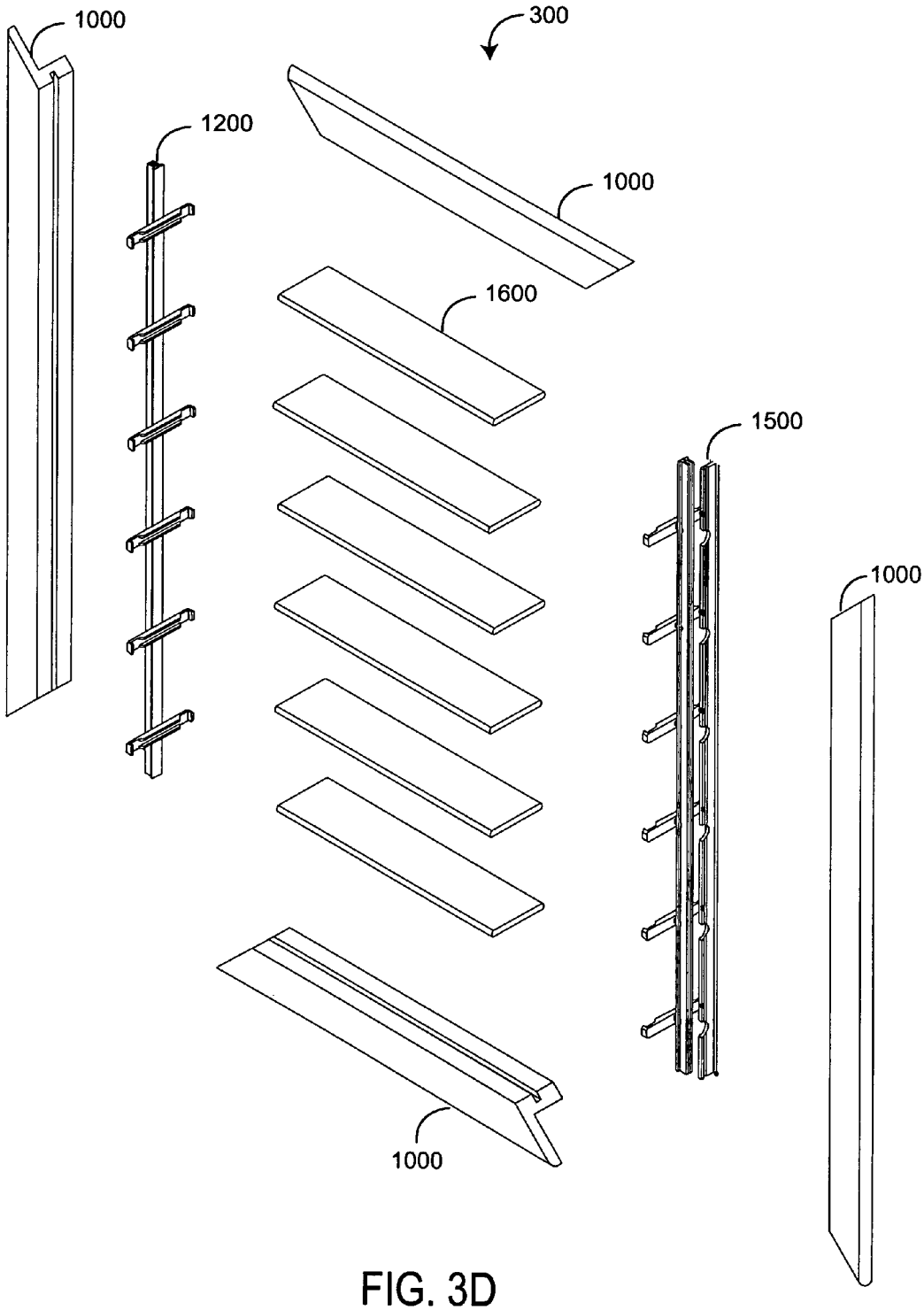

FIGS. 3A-C illustrate a full view shutter 300 having a frame 700 that advantageously integrates the trim features of a conventional window frame with the mounting functionality of conventional stiles. This substantially increases the viewable area through the shutter. This also eliminates the necessity for a shutter panel that opens on hinges. As a result, the weight of the full view shutter 300 is significantly reduced as compared to that of a conventional window frame and shutter panel. This, along with easy assembly of the frame 700 supports a ready to assemble (RTA) kit embodiments of the full view shutter 300 that substantially reduces the lead-time and expense of factory assembled and professionally installed shutters.

Figure 12A:
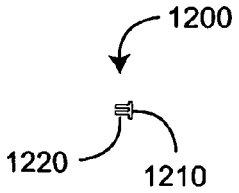
FIGS. 12A-C are top, front and side views, respectively, of an insert.
Figure 12B:
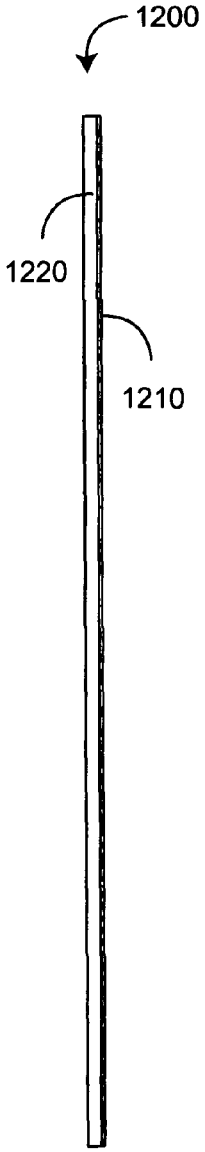
Figure 12C:
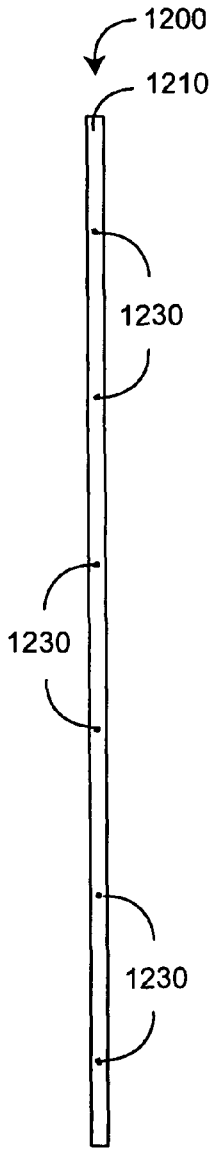
Figure 16A:
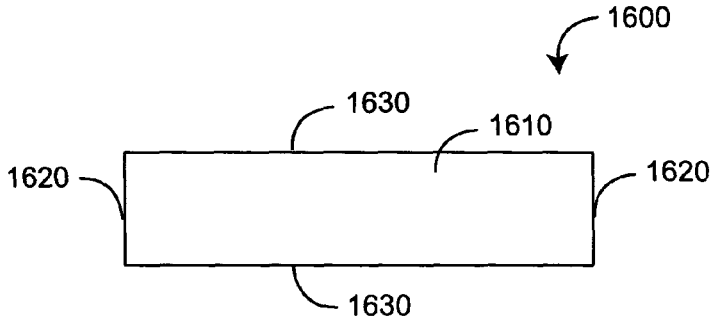
FIGS. 16A-C are top, front and side views, respectively, of a louver.
Figure 16B:
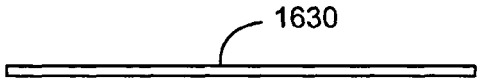
Figure 16C:
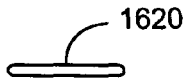

As shown in FIGS. 3A-C, the full view shutter 300 has frame components 1000 that are attached to form the frame 700, as described in detail with respect to FIGS. 7A-C, below. Inserts 1200 are adapted to be fitted within the frame components 1000 as described in detail with respect to FIGS. 8A-C, below. Louvers 1600 are adapted to be removably attached to louver clips 1300, 1400, as described in detail with respect to FIG. 9, below. FIGS. 10-11 detail the frame components 1000. FIGS. 12A-C detail the insert 1200. FIGS. 13-14 detail the louver clips 1300, 1400. FIGS. 16A-C detail the louvers 1600.

Further shown in FIGS. 3A-C, there is no louver-mounted tilt bar to block the view through the shutter. Instead, louvers 1600 are opened and closed by moving an individual louver 1600, which moves all the louvers 1600 via a light stop tilt bar 1500. Advantageously, the light stop tilt bar 1500 fits between the louvers and the frame to block light from passing through that gap when the full view shutter 300 is closed. There may be one tilt bar 1500 on either side of the full view shutter 300 or two tilt bars 1500, one on each side of the full view shutter 300. The tilt bar or tilt bars 1500 may be located on the back of the full view shutter 300 (shown) or on the front of the full view shutter 300. A tilt bar on the front of the full view shutter 300 advantageously functions as a handle for opening and closing the shutters. In one embodiment, an integrated grip is molded or separately attached to a tilt bar installed on the front of the full view shutter 300. The light stop tilt bar 1500 is described in detail with respect to FIGS. 15A-C, below.

Figure 4A:
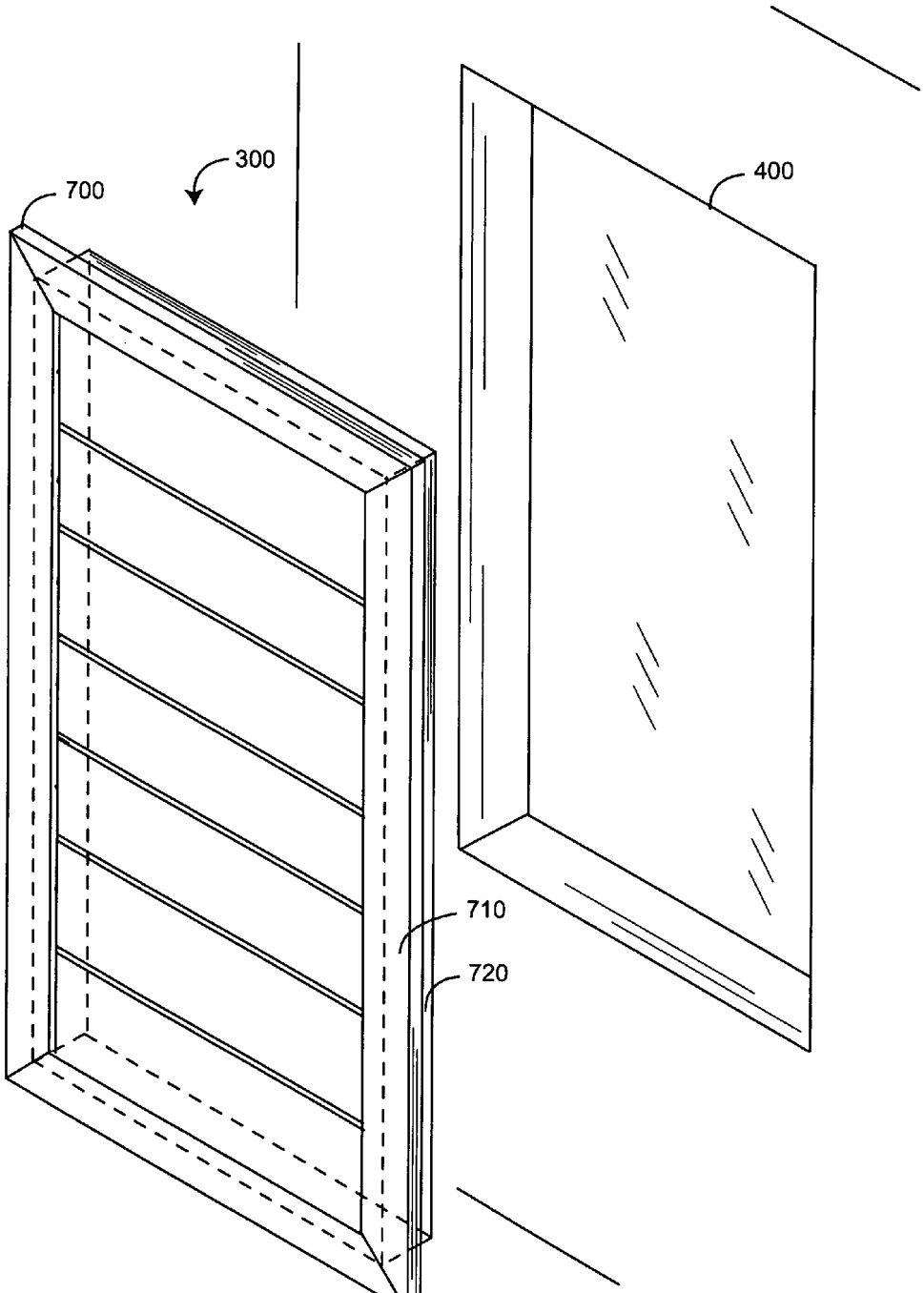
FIGS. 4A-B are front perspective views of an uninstalled and an installed full view shutter.
Figure 4B:
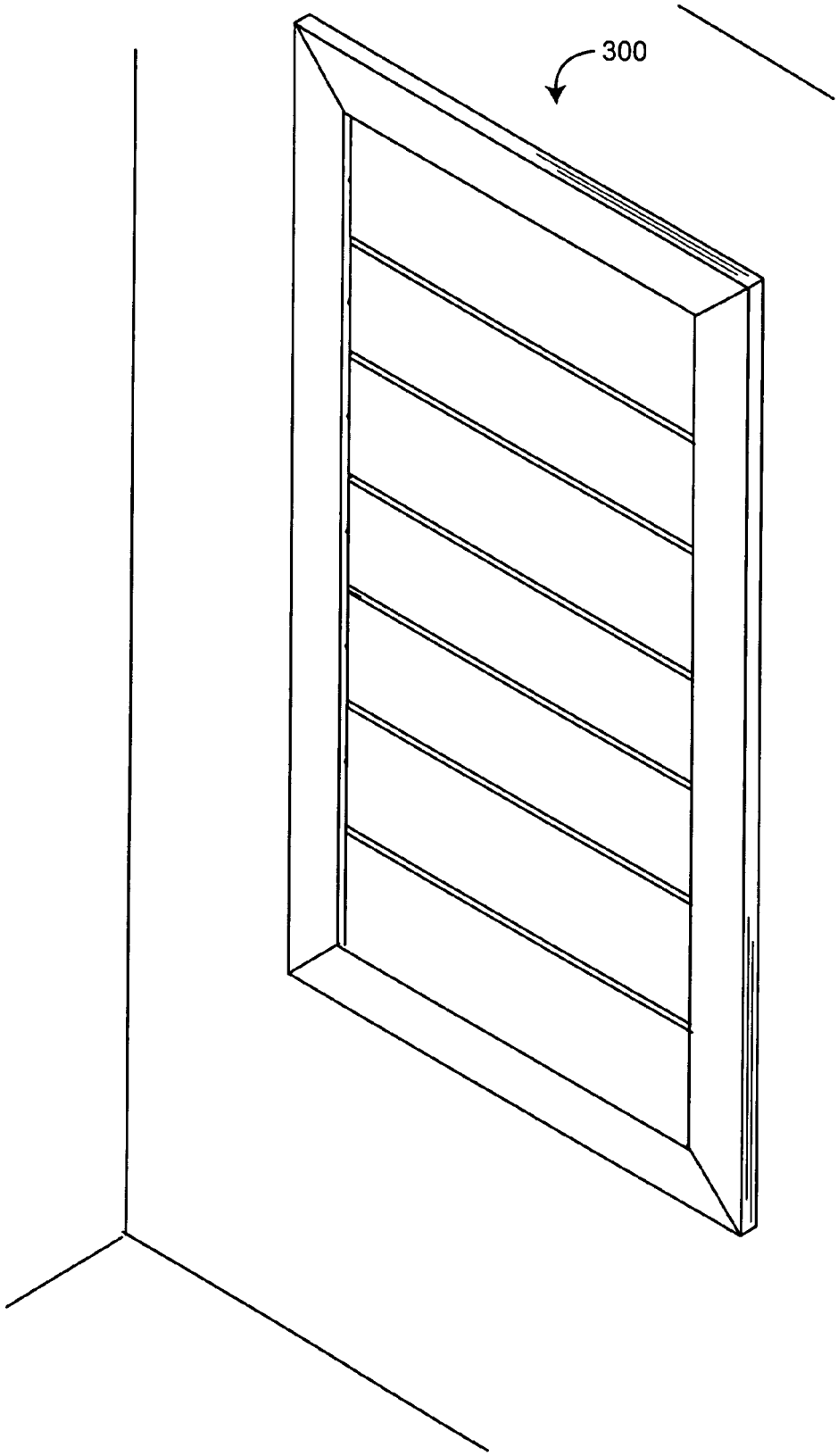

FIGS. 4A-B illustrate installation of the full view shutter 300. Advantageously, the full view shutter is easy for the end user to size and install, eliminating the expense of professional shutter installation. The frame 700 is first sized to fit within a window opening 400. Sizing is facilitated by the frame 700, which has a trim 710 that fits around the periphery of the window opening and a support 720 that inserts into the window opening and rests along the window sill, supporting the shutter weight. Gaps between the support 720 and window opening 400 are covered by the trim 710. Large gaps can be reduced by spacers, as described with respect to FIGS. 19A-F, below. In one embodiment, the full view shutter 300 is removable. In particular, sections of Velcro® or other detachable securing mechanisms are fixedly attached around the outside periphery of the window opening 400. Corresponding sections are fixedly attached around the backside periphery of the frame 700. In another embodiment, the full view shutter 300 is semi-permanently installed with screws or similar fastening devices. Advantageously, the louvers can be removed prior to installation or removal of the shutter 300, making the shutter significantly lighter and easier to handle.

Figure 5A:
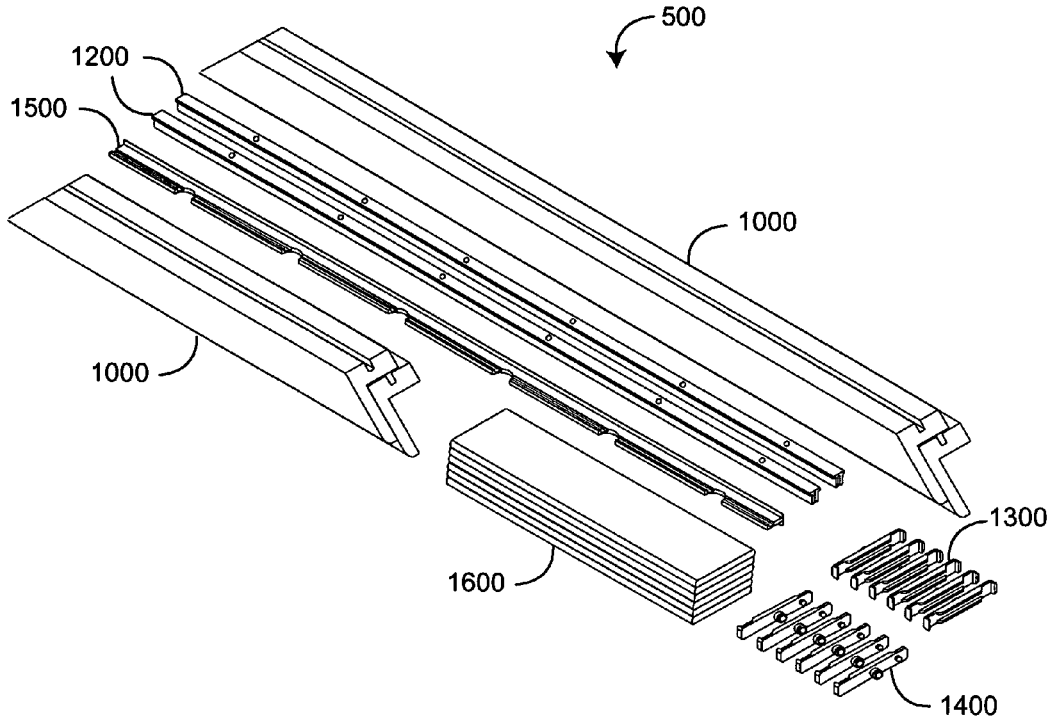
FIGS. 5A-B are perspective views of ready-to-assemble (RTA) full view shutter kit embodiments.
Figure 5B:
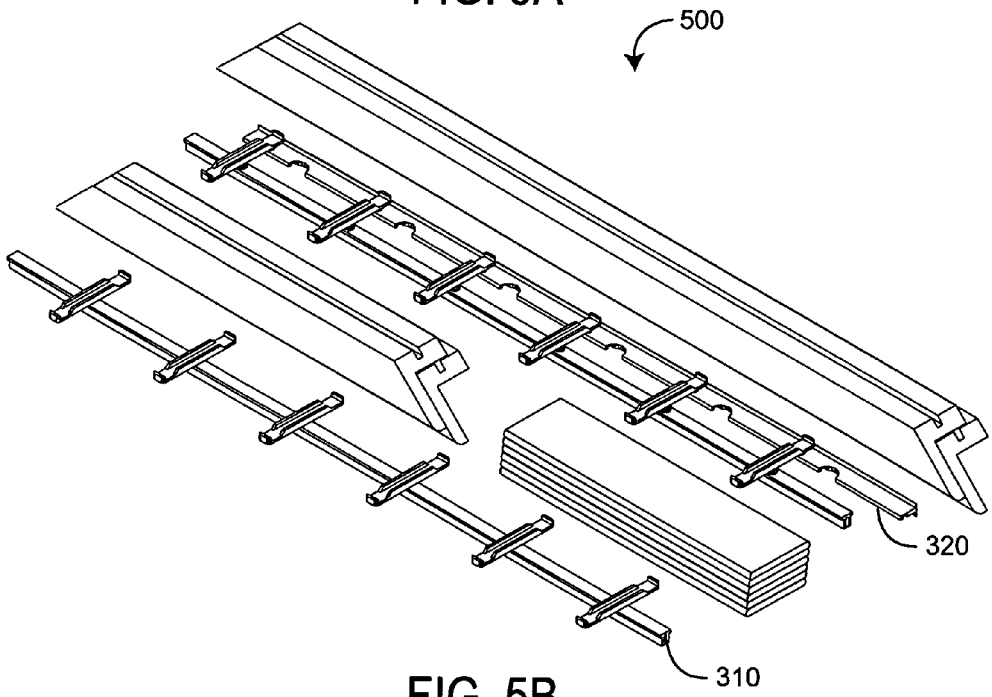

FIGS. 5A-B illustrate a shutter kit 500 that may be packaged, shipped and delivered as a ready-to-assemble (RTA) shutter that is easily built and installed by a layperson. Alternatively, the shutter kit components may be sold through outlets. The kit components may be cut to customer specifications or provided in standard sizes, as described in further detail below. As shown in FIG. 5A, an unassembled kit embodiment has frame components 1000, inserts 1200, unspaced louver clips 1300, spaced louver clips 1400, one or more tilt bars 1500 and louvers 1600. The frame components 1000 may come in two sizes, corresponding to vertical (stile) and horizontal (spreader) frame members, respectively. A partially assembled kit embodiment (FIG. 5B) has preassembled louver clip "trees" 310, 320 having unspaced and spaced louver clips 1300, 1400 pressed into the inserts 1200 and the tilt bar 1500 pressed onto the spaced louver clips 1400. In one embodiment, the frame components 1000 and louvers 1600 are constructed of prefinished fiberboard and the inserts 1200, tilt bars 1500 and louver clips 1300, 1400 are constructed of plastic. Prefinished fiberboard shutter components, inserts, louver clips ("end caps") and removable louvers are described in U.S. Pat. No. 6,622,433 entitled Prefinished Medium Density Fiberboard Shutter, issued to the inventor of the current invention and incorporated by reference herein.

Figure 6:
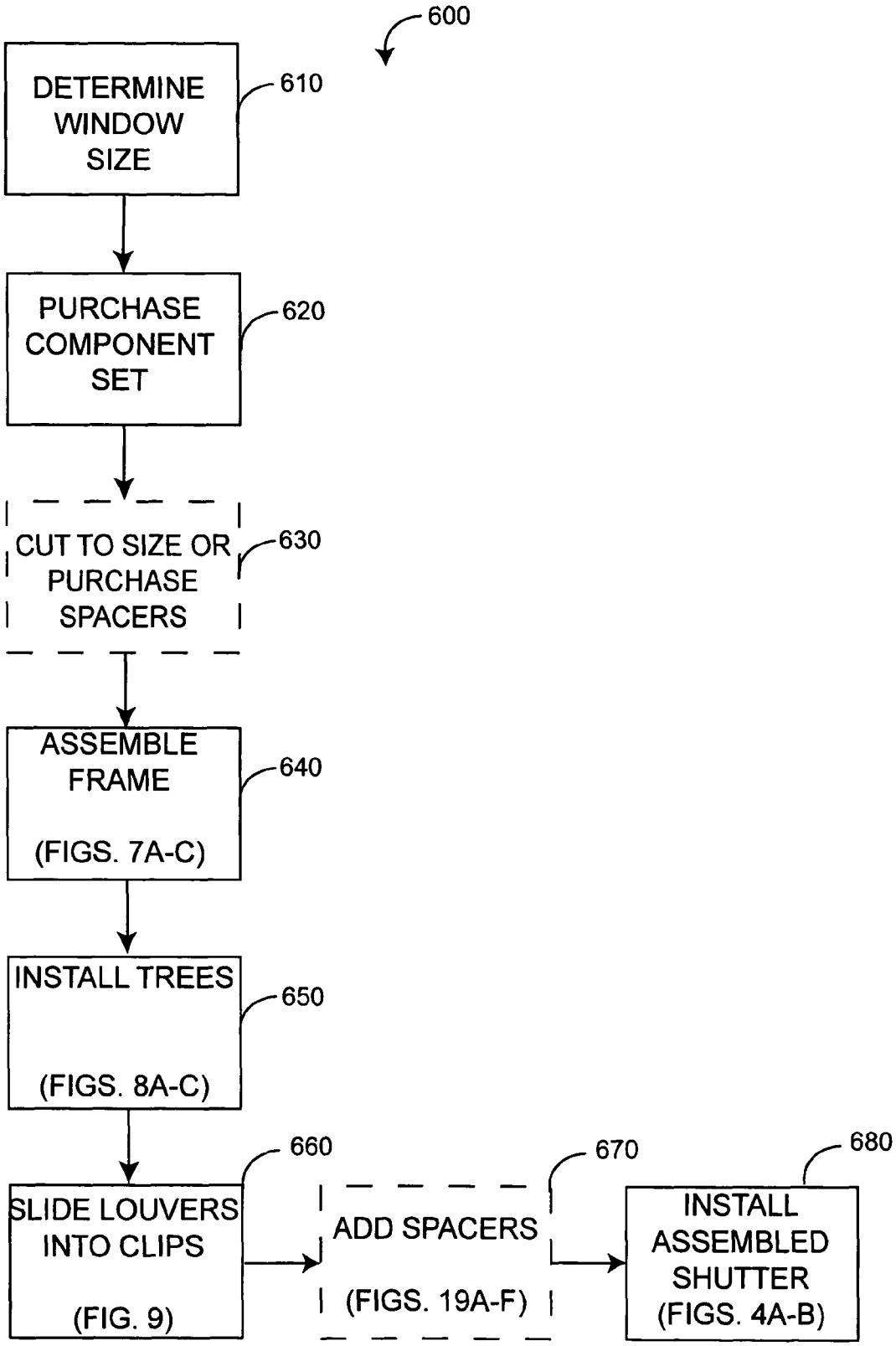
FIG. 6 is a flow diagram of a full view shutter assembly and installation process.

FIG. 6 illustrates a shutter kit assembly and installation process 600. Initially, an end user determines their window size 610. Based on window size, the end user purchases a set of shutter components 620, such as illustrated in FIGS. 5A-B. In one embodiment, shutter components may be pre-packaged according to various standard sizes. In another embodiment, shutter components may be individually selected and matched according to various standard sizes. A mechanical or electronic calculation device may be utilized that has window sizes as an input and that indicates corresponding component sizes as an output. The sizing can be further refined by cutting components to size or purchasing spacers 630. In a particularly advantageous embodiment, the combination of a frame having a trim 710 (FIGS. 7A-C) that overlaps a window opening and spacers 1900 (FIGS. 19A-F) that fill in between standard sizes minimizes the number of stock keeping units (SKUs). Next, the frame is assembled 640, as shown and described with respect to FIGS. 7A-C. The frame can be assembled to enclosed standard louvers having pins. Alternatively, trees having louver clips are installed into the frame 650, as shown and described with respect to FIGS. 8A-C, and louvers are removably installed into the clips 660, as shown and described with respect to FIG. 9. Spacers are added 670 if needed, and the assembled shutter is installed 680, as shown and described with respect to FIGS. 4A-B.

Figure 7A:
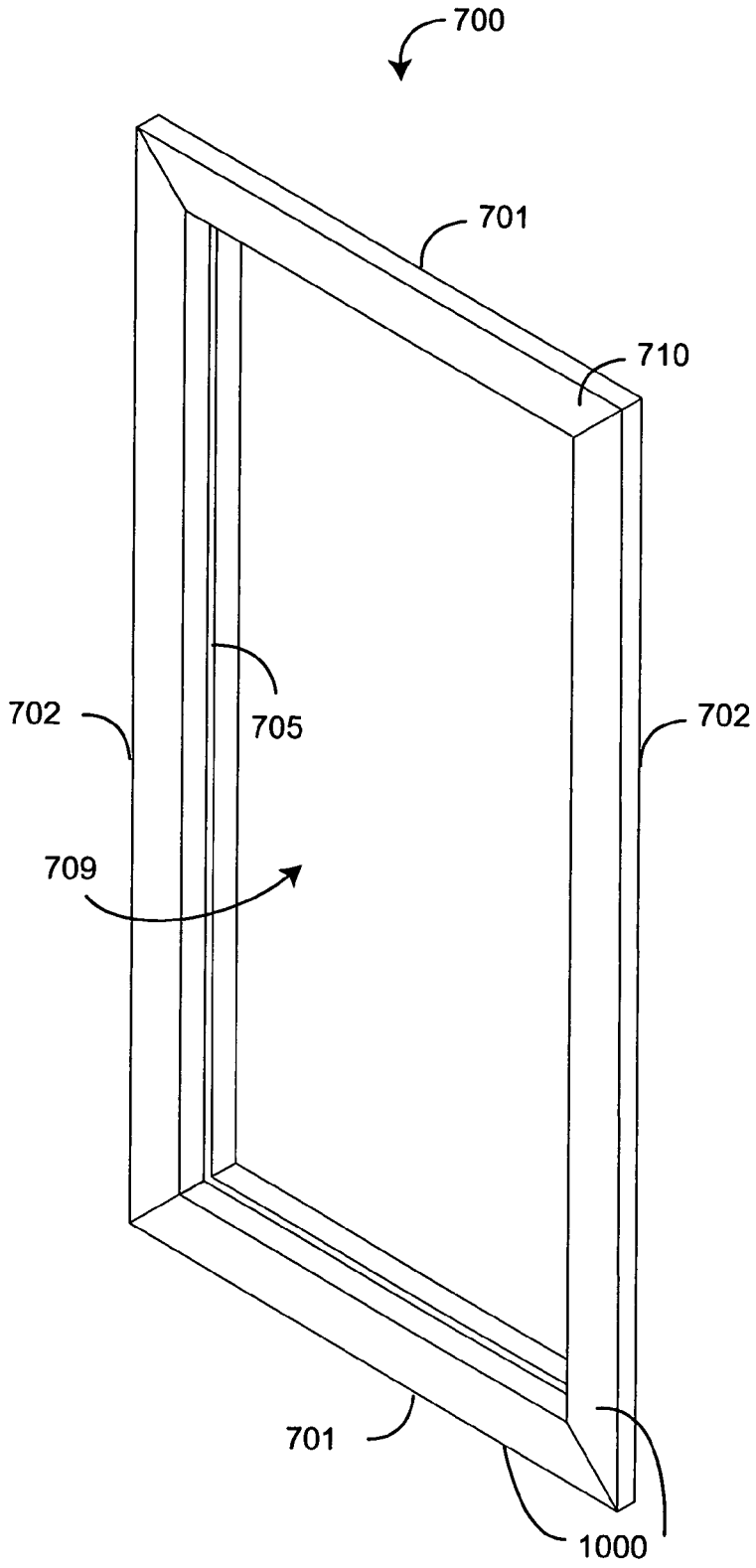
FIGS. 7A-C are front perspective, back perspective and back plan views, respectively, of a frame.
Figure 7B:
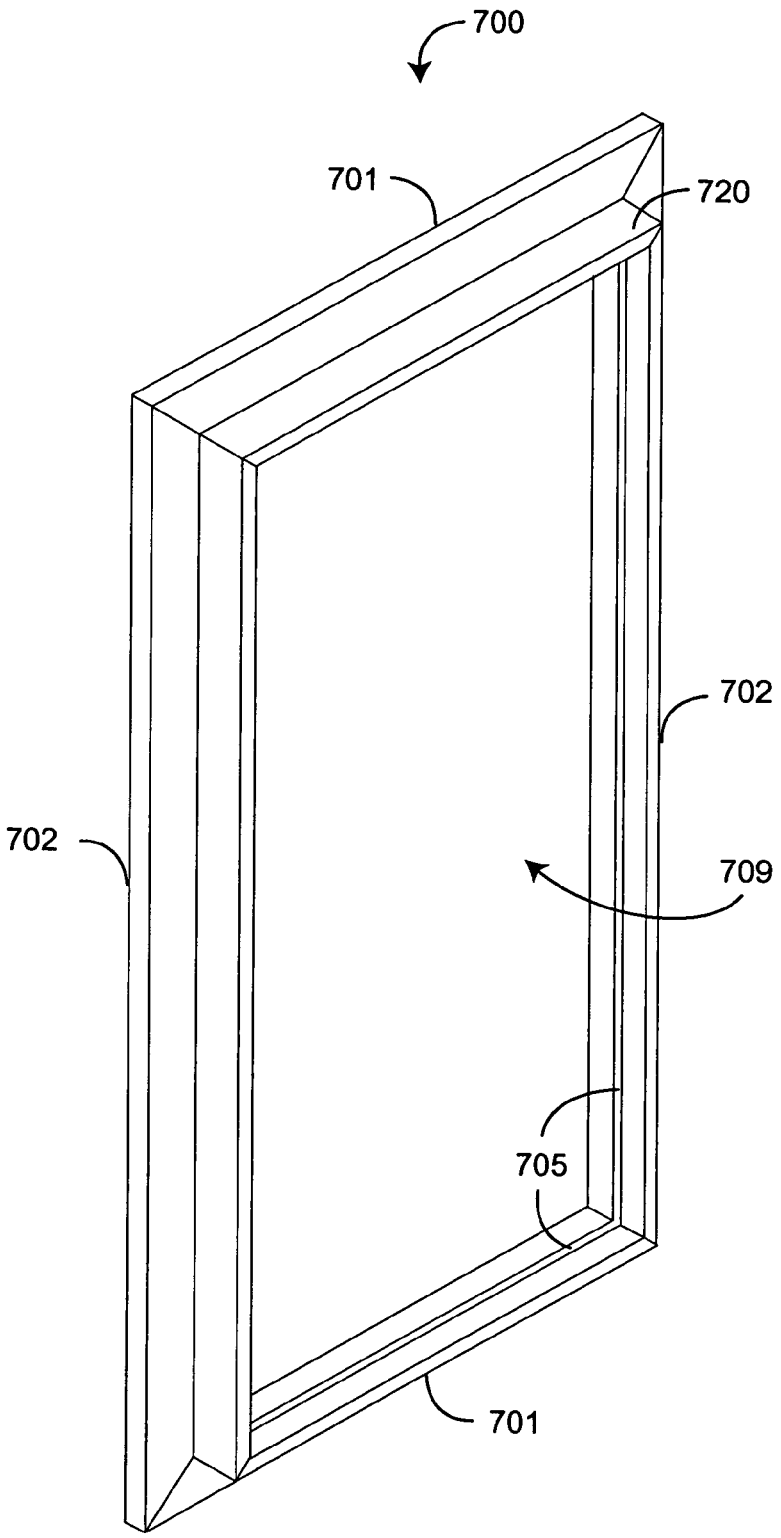
Figure 7C:
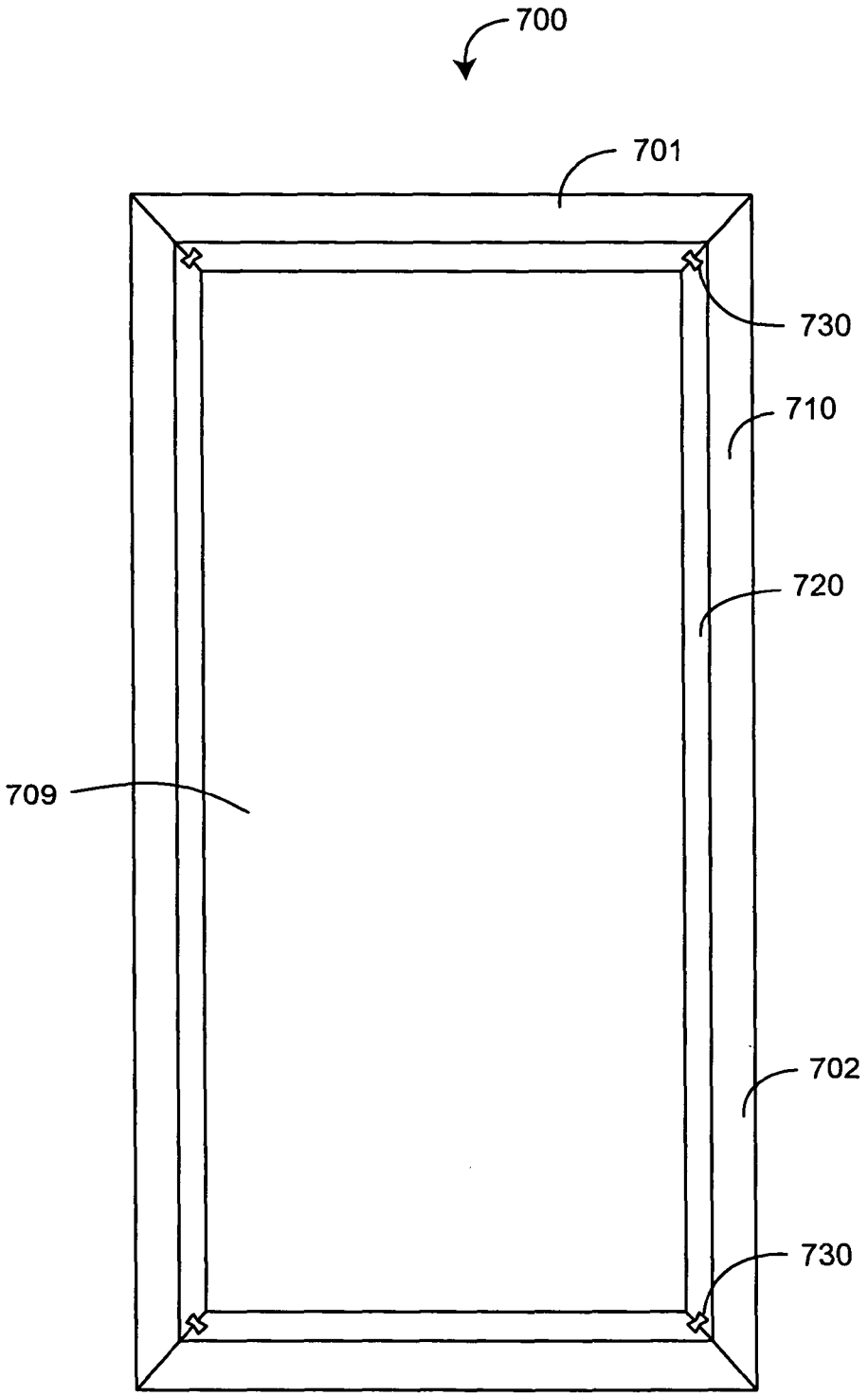

FIGS. 7A-C illustrate the full view shutter frame 700, which is advantageously constructed of two pairs 701, 702 of the same frame component 1000, each pair differing, perhaps, only in length. Further, an end user can easily join the individual frame components 1000 along diagonal cut ends 1030 (FIGS. 10A-D) and fixedly attached the frame components 1000 together with press fit Hoffman keys 730. Alternatively, or in addition to the keys 730, screws or similar fasteners can be used to attach the frame components 1000. The assembled frame 700 has a trim 710 and a corresponding support 720 defining a frame opening 709. A frame groove 705 is defined by the support 720 proximate the opening 709. The frame 700 is configured to encompass the louvers 1600 (FIGS. 3A-B) within the opening 709. In a removable louver shutter embodiment described here and below, louvers are installed after frame assembly and installation. In a fixed louver shutter embodiment, the frame groove 705 is replaced with pin holes. Accordingly, an end user encloses louvers during frame assembly, and the louvers are held to the frame with louver pins inserted into the louver ends and the pin holes.

Figure 8A:
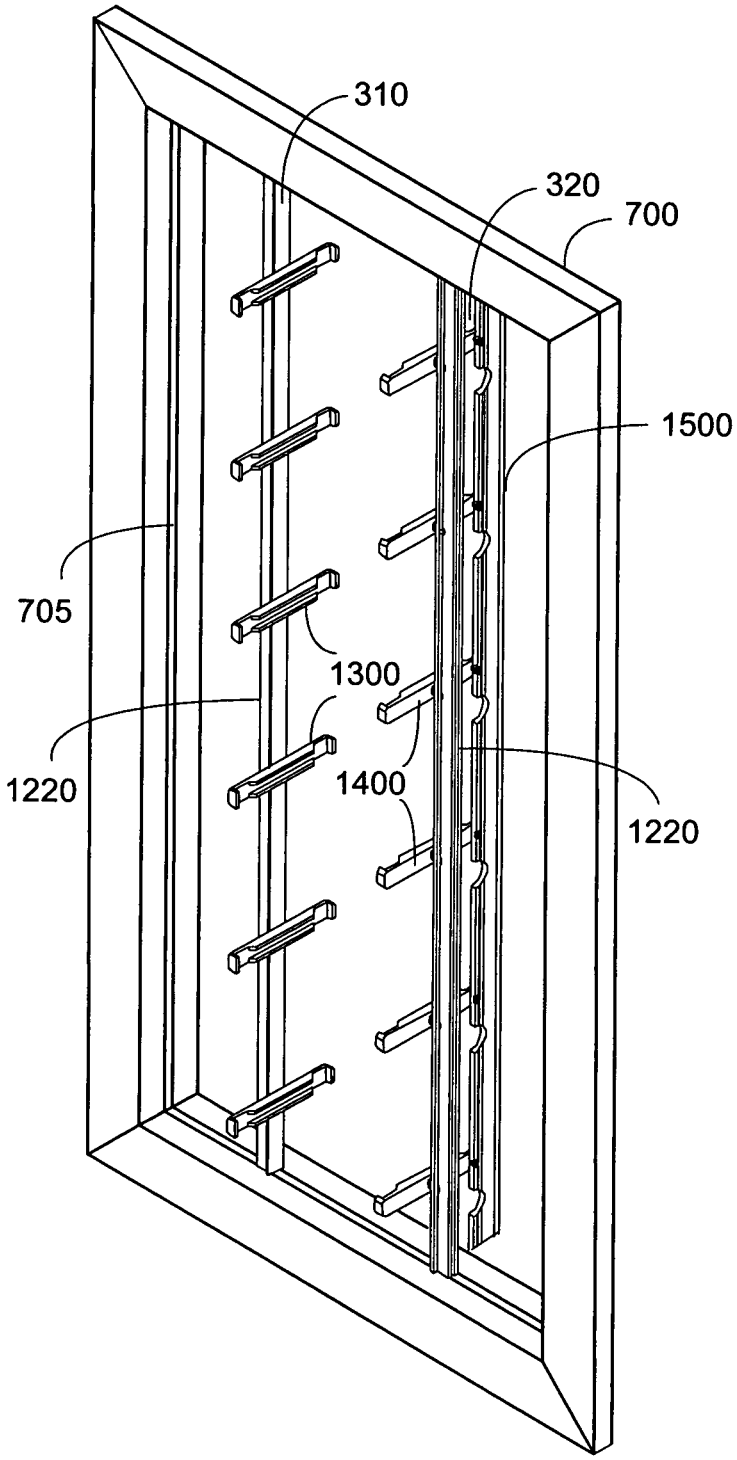
FIGS. 8A-C are front perspective views of tree installation in the frame.
Figure 8B:
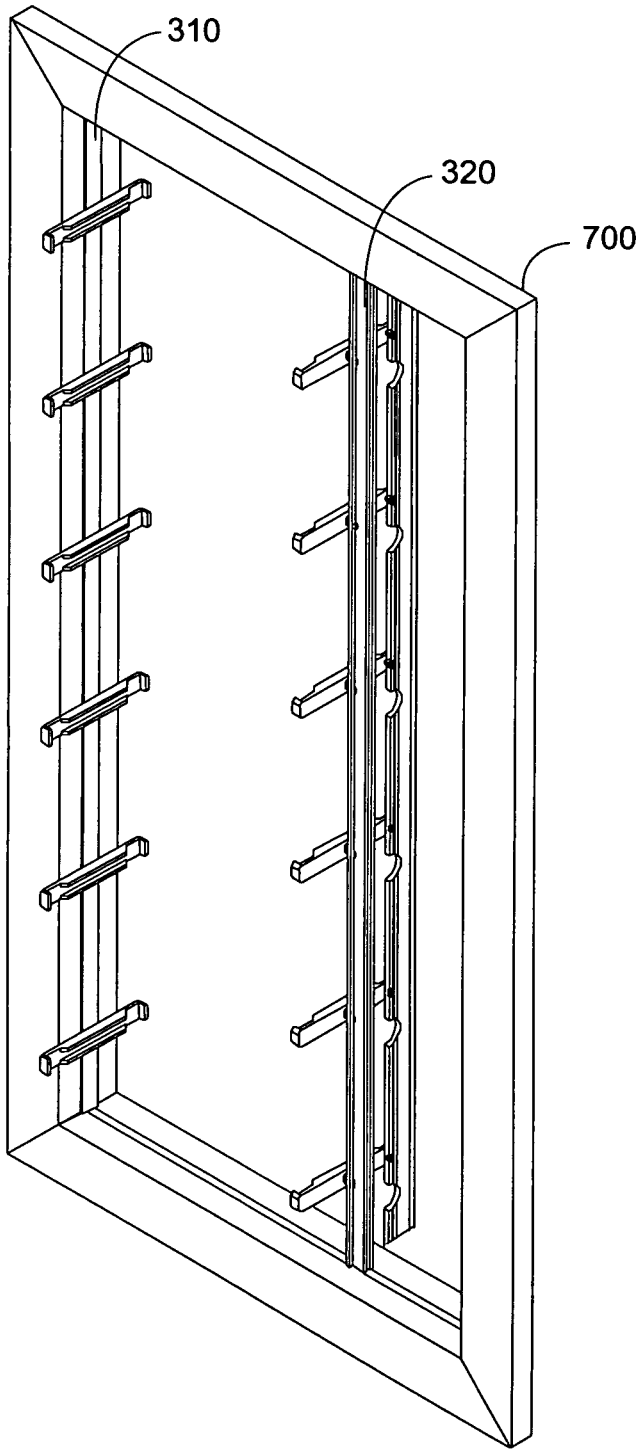
Figure 8C:
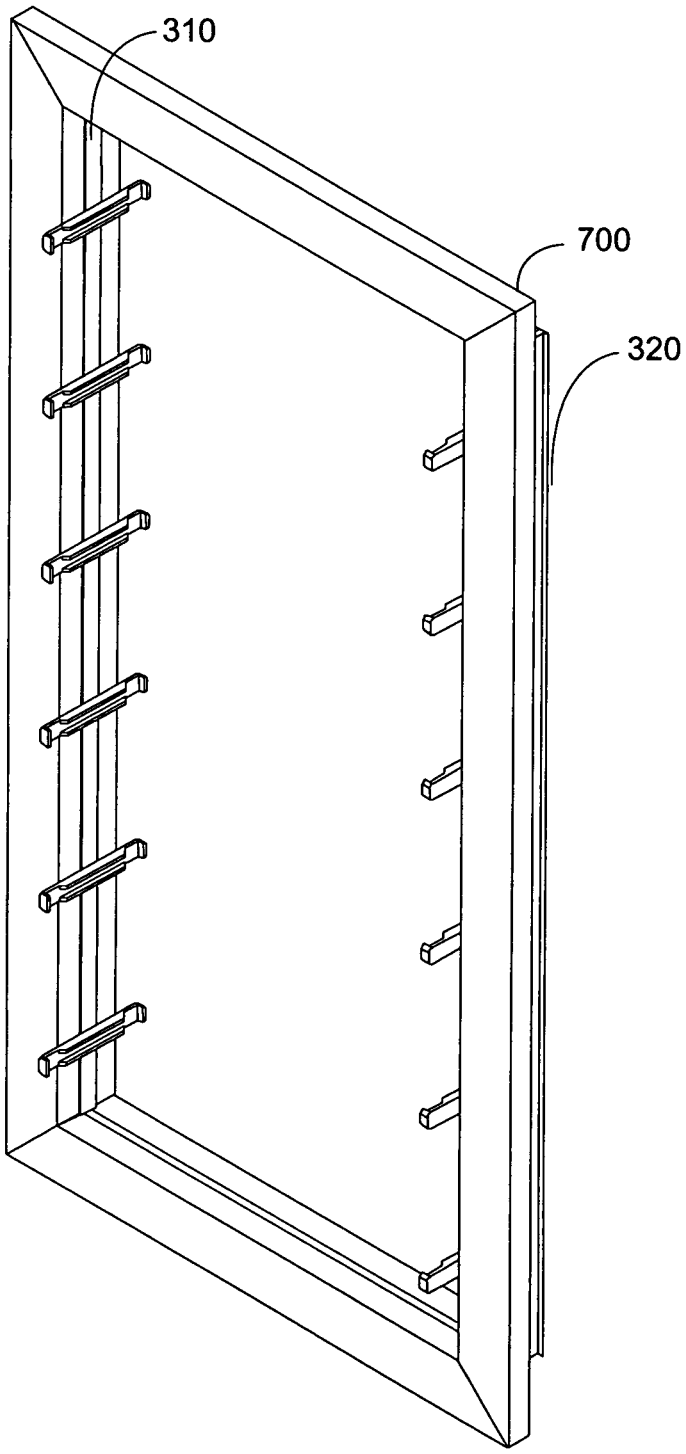

FIGS. 8A-C illustrate assembly of the trees 310, 320 into the frame 700. An unspaced tree 310 has an insert 1200 and unspaced louver clips 1300. A spaced tree 320 has an insert 1200, spaced louver clips 1400 and an attached light stop tilt bar 1500. The spaced louver clips 1400 accommodate corresponding notches of the tilt bar 1500 so that, when the louvers are closed, the tilt bar is fully disposed between the louvers and the frame 700. The louver clips 1300, 1400 are pressed into and rotatably retained by the inserts 1200. As shown in FIGS. 8B-C, the insert 1200 of each tree 310, 320 has a tongue 1220 extending the length of the insert 1200 that is pressed into the frame groove 705 so that the frame 700 retains the trees 310, 320.

Figure 9:
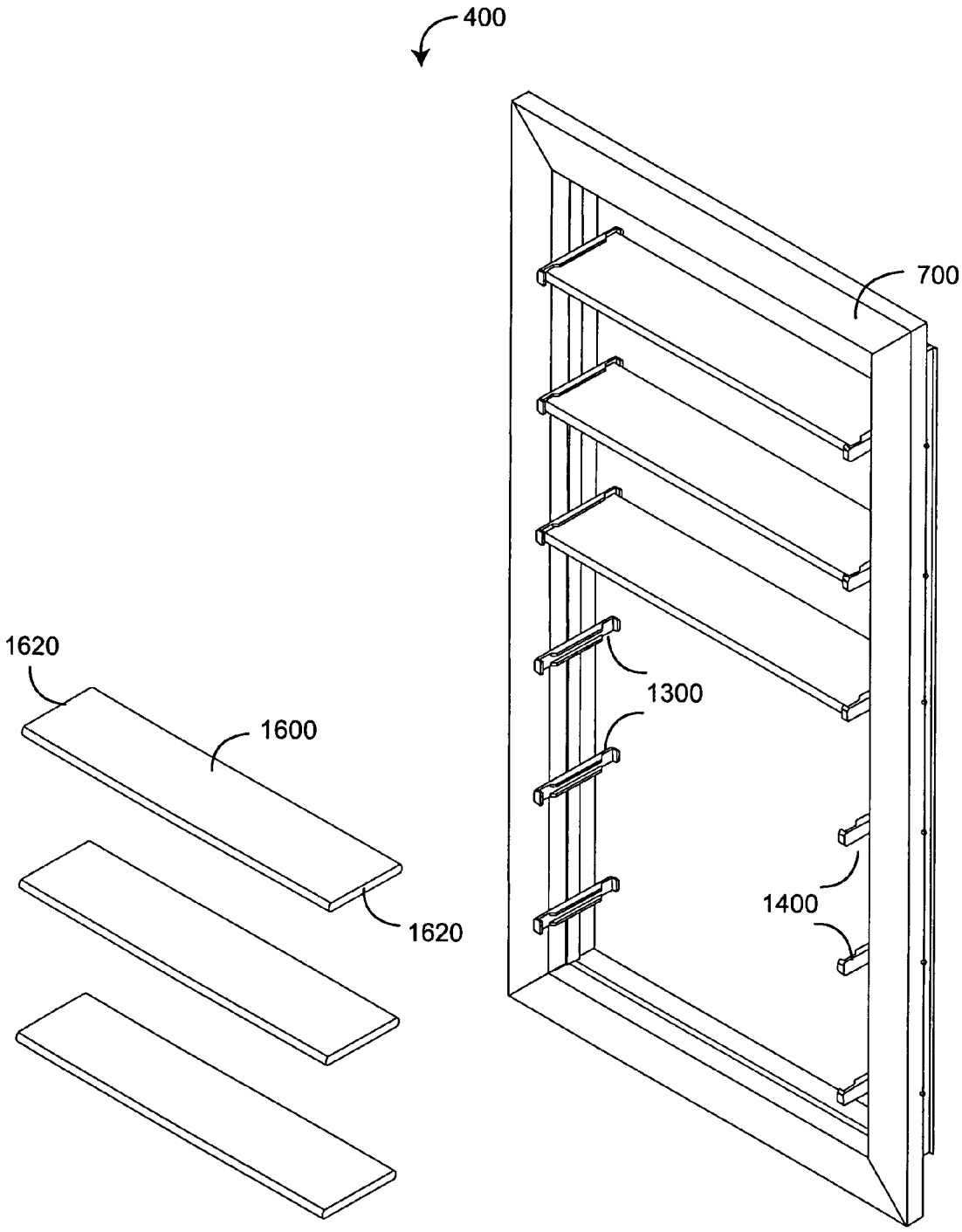
FIG. 9 is a front perspective view of louver installation.
Figure 10A:
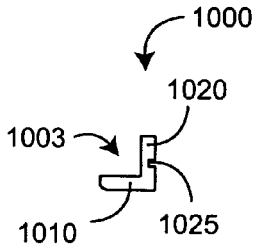
FIGS. 10A-D are top, left side, front and right side views, respectively, of a frame component embodiment.
Figure 10B:
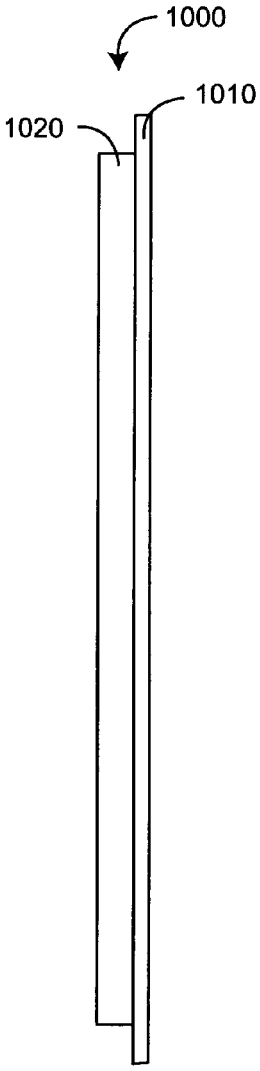
Figure 10C:
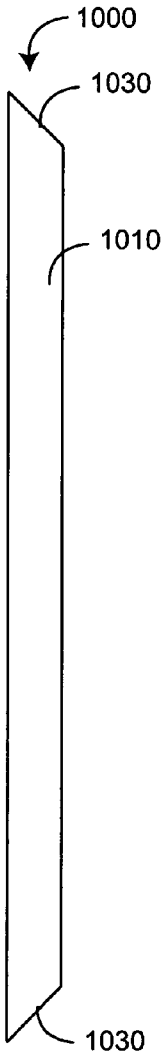
Figure 10D:
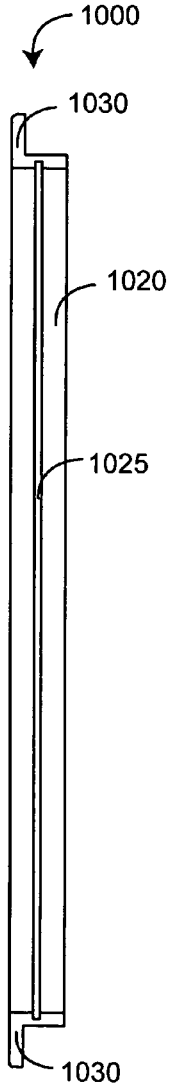
Figure 11A:
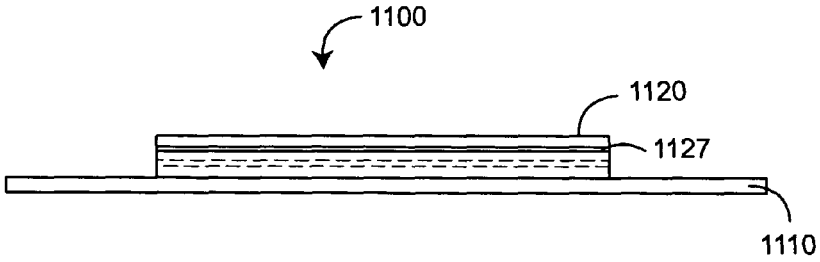
FIGS. 11A-D are top, front, side and bottom views, respectively, of an alternative frame component embodiment.
Figure 11B:
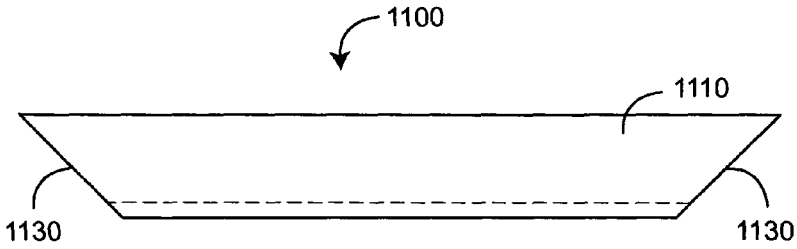
Figure 11C:
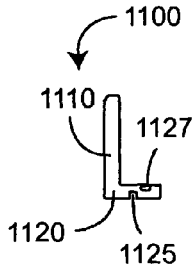
Figure 11D:
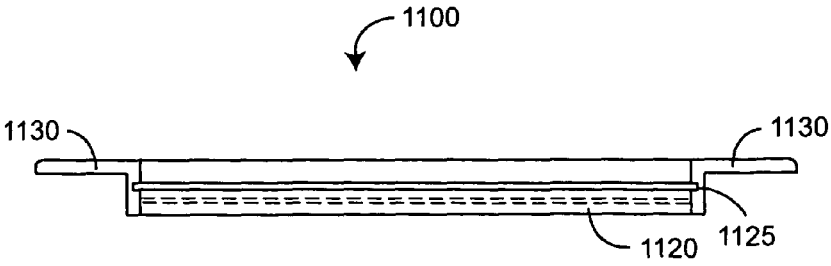

FIG. 9 illustrates louver installation into the frame 700. In particular, louver ends 1620 slide into and are removably retained by the louver clips 1300, 1400.

FIGS. 10A-D illustrate a frame component 1000 that provides both the vertical and horizontal members of the frame 700 (FIGS. 7A-C). As such, each member of the frame 700 is advantageously manufactured by a common process and cut to size as a final process step. In one embodiment, unseparated and unsized frame components, louvers and trees are supplied as manufactured to wholesalers and distributors, for example, who then perform the final process step of cutting and sizing individual shutter parts. The frame component 1000 has a trim section 1010, a support section 1020 and diagonal-cut ends 1030. The trim section 1010 extends generally perpendicularly to the support section 1020 so as to form an L-shape cross-section. The diagonally-cut ends 1030 are adapted to fixedly attach to corresponding diagonally-cut ends 1030 of other frame components 1000 so as to fit into the corners of a window opening 400 (FIG. 4A). An inside edge 1003 is configured to align proximate an edge of the window opening 400 (FIG. 4A). A groove 1025 extends along the length of the support section 1020 and is configured to accept an insert 1200 (FIGS. 12A-C). In one embodiment, the frame component 1000 is constructed of prefinished fiberboard.

FIGS. 11A-D illustrate an alternative frame component embodiment 1100 that accepts spacers 1900 for end user sizing of the frame 700 to a particular window opening 400 (FIG. 4A), as described with respect to FIGS. 19A-F, below. The frame component has a trim section 1110, a support section 1120, a groove 1125 and diagonal-cut ends 1130 that function as described with respect to the frame component embodiment 1000 (FIGS. 10A-D), above. In addition, the frame component 1100 has a spacer groove 1127 configured to interlock with a spacer tongue 1920 (FIGS. 19A-F) so as to removably retain a spacer 1900.

FIGS. 12A-C illustrate an insert 1200, which is an elongated tree component having a shelf 1210 and a tongue 1220. The tongue 1220 provides a friction fit within a frame groove 705 (FIGS. 7A-B) and the shelf 1210 rests along the frame support 720 (FIGS. 7A-B). Multiple pin holes 1230 are evenly spaced along the shelf 1210 that rotatably retain unspaced louver clips 1300 (FIGS. 13A-D) or spaced louver clips 1400 (FIGS. 14A-D), as described below. In one embodiment, the insert 1200 is a single section of extruded plastic or similarly flexible material that is cut to size corresponding to a particular frame component length.

FIGS. 13A-D illustrate an unspaced louver clip 1300, which is adapted to removably retain a louver 1600 (FIGS. 16A-C), as described in detail below. The unspaced louver clip 1300 has a body 1310, side flaps 1320, end flaps 1330 and an insert button 1340. The body 1310 is generally planar with an inside face 1301 and an outside face 1302 and is configured to cover a louver end 1620 (FIGS. 16A-C) so that the inside face 1301 is proximate the louver 1600 (FIGS. 16A-C) and the outside face 1302 (FIGS. 16A-C) is distal the louver 1600. The side flaps 1320 and end flaps 1330 extend normally to the body 1310 from the inside face 1301 and are configured so that the side flaps 1320 grip the louver faces 1610 (FIGS. 16A-C) and the end flaps 1330 grip the louver edges 1630 (FIGS. 16A-C). Accordingly, an unspaced louver clip 1300 is constructed of a material having some flexibility, such as a thin plastic, so that one or more of the side flaps 1320 and end flaps 1330 can be deflected for attachment or detachment to a louver 1600.

Figure 13A:
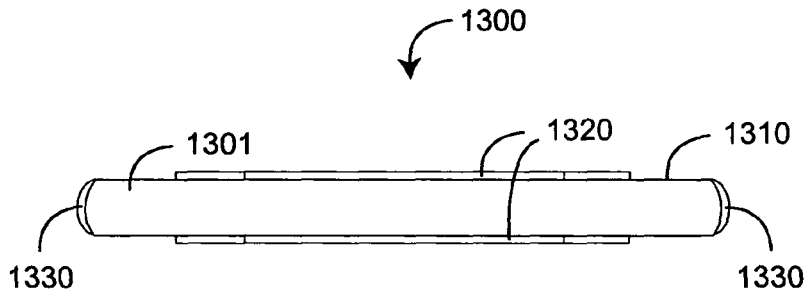
FIGS. 13A-D are front, top, side and back views of an unspaced louver clip.
Figure 13B:
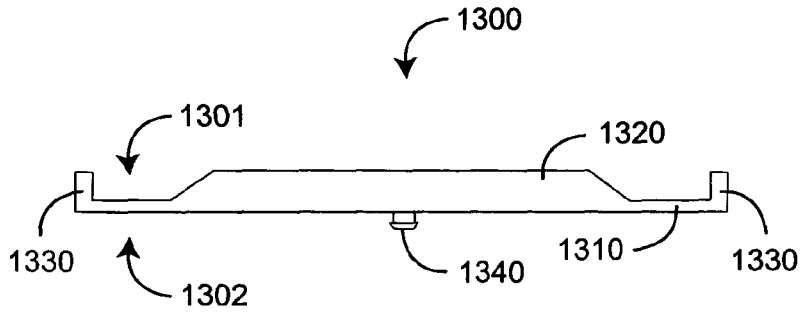
Figure 13C:
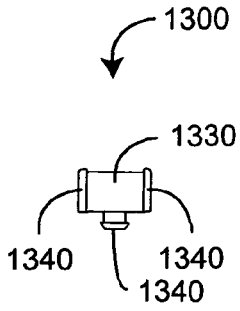
Figure 13D:
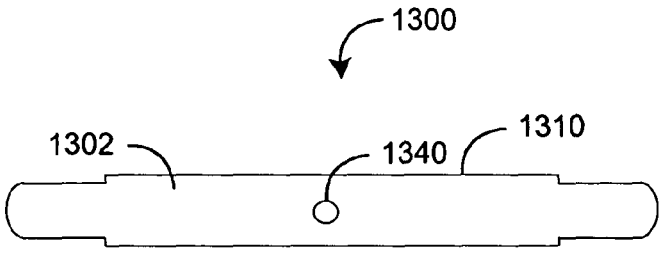
Figure 14A:
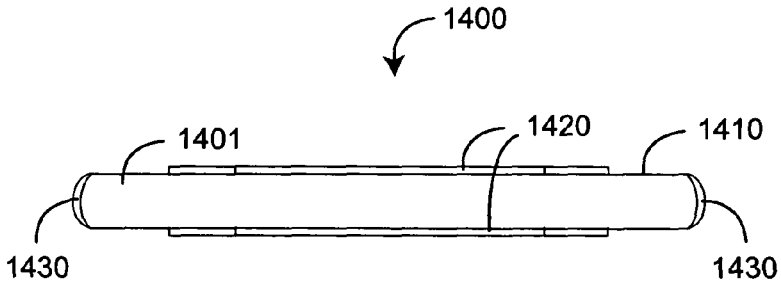
FIGS. 14A-D are front, top, side and back views, respectively, of a spaced louver clip.
Figure 14B:
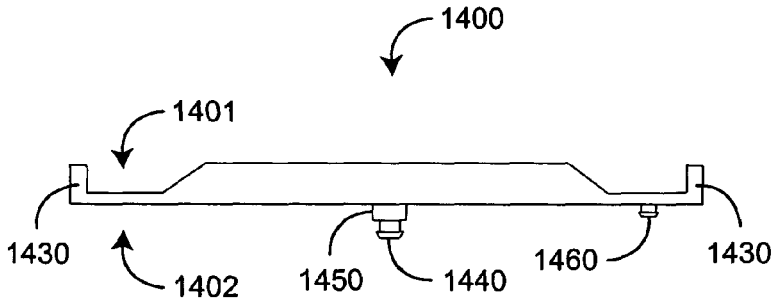
Figure 14C:
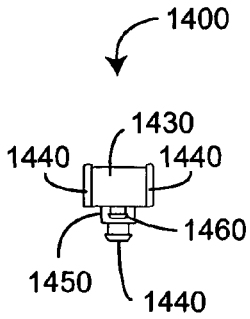
Figure 14D:
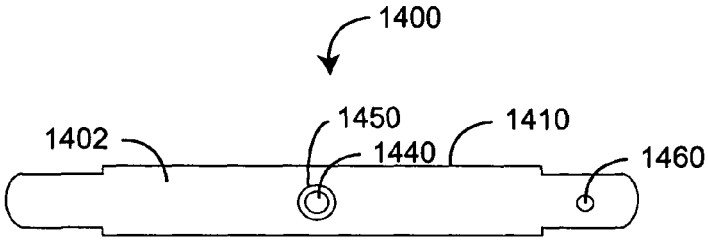

As shown in FIG. 13B-D, the insert button 1340 is adapted to snap into and be rotatably retained inside an insert pin hole 1230 (FIGS. 12A-C) so that a louver 1600 (FIGS. 16A-C) can be rotatably retained within the frame 700 (FIGS. 7A-C). In one embodiment, the insert button 1340 extends normally from the louver clip outside face 1302 and has a catch that snaps inside a pin hole 1230 (FIGS. 12A-C). In an alternative embodiment, not shown, the side flaps 1320 or end flaps 1330 or both are replaced by a wedge, prongs or similar structure extending from the center of the inside face 1301 and adapted to insert into, and fixedly attached to, a louver end 1620 (FIGS. 16A-C).

FIGS. 14A-D illustrate a spaced louver clip 1400, which is adapted to removably retain a louver 1600 (FIGS. 16A-C), as described in detail below. The spaced louver clip 1400 has a body 1310, side flaps 1420, end flaps 1430, which are the same in configuration and function as described for the unspaced louver clip 1300 with respect to FIGS. 13A-D, above. The spaced louver clip 1400 also has an insert button 1440 formed on a spacer 1450. The insert button 1440 functions as described for the unspaced louver clip 1300 with respect to FIGS. 13A-D, above. The spacer 1450 is described below.

As shown in FIGS. 14A-D, the spaced louver clip 1400 is also adapted to rotatably retain a tilt bar 1500 (FIGS. 15A-C), as described in detail, below. In particular, the spaced louver clip 1400 has a tilt bar button 1460 adapted to snap into a tilt bar hole 1530 (FIG. 15C) and be recessed within a tilt bar groove 1540. In a closed position, the tilt bar 1500 (FIGS. 15A-C) has notches 1530 (FIG. 15C) that accommodate the spacers 1450. In one embodiment, the tilt bar button 1460 extends normally from the louver clip outside face 1402 proximate one end and has a catch that snaps inside the tilt bar hole 1530 (FIG. 15C). In this manner, the tilt bar 1500 can connect multiple louvers 1600 (FIGS. 16A-C), as described with respect to FIGS. 15A-C, below. Also, the tilt bar 1500 (FIGS. 15A-C) fits between the louvers 1600 (FIGS. 16A-C) and the frame 700 (FIGS. 7A-C).

Figure 15A:
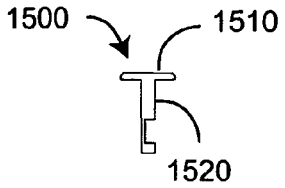
FIGS. 15A-C are top, front and side views, respectively, of a light stop tilt bar.
Figure 15B:
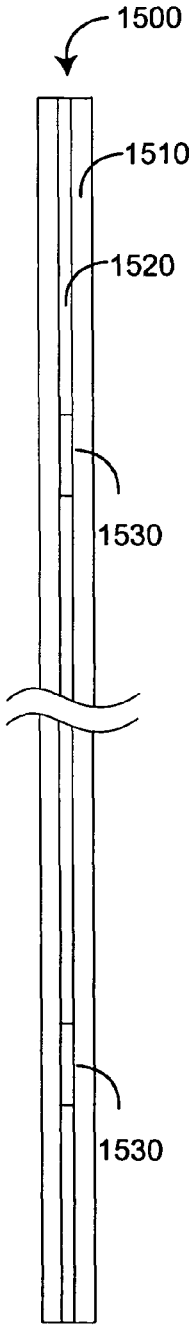
Figure 15C:
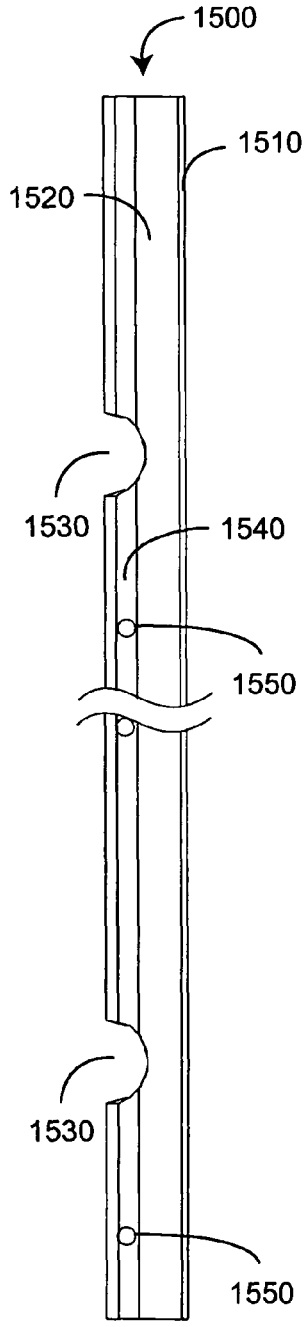

FIGS. 15A-C illustrate a light stop tilt bar 1500, which advantageously functions both as a tilt bar to interconnect and rotate the louvers 1600 (FIGS. 3A-B) and as a mechanism for blocking light from "leaking" between the frame and the louvers on a closed shutter. The tilt bar 1500 is an elongated, generally T-shaped piece having a cross bar 1510, a leg 1520 extending generally perpendicularly from the cross bar 1510, tilt bar holes 1550 evenly distributed along the length of the tilt bar 1500 within a groove 1540 extending the length of the tilt bar 1500, and notches 1530 evenly distributed along the leg 1520. In particular, the leg 1520 is configured to fit in the gap between the frame 700 (FIGS. 7A-C) and the louver ends 1620 (FIGS. 16A-C), and the cross bar 1510 is configured to fit across that gap, effectively blocking light from passing through the gap. The notches 1530 accommodate corresponding louver clip spacers 1450 (FIGS. 14B-D) when the shutter is closed.

Figure 2:
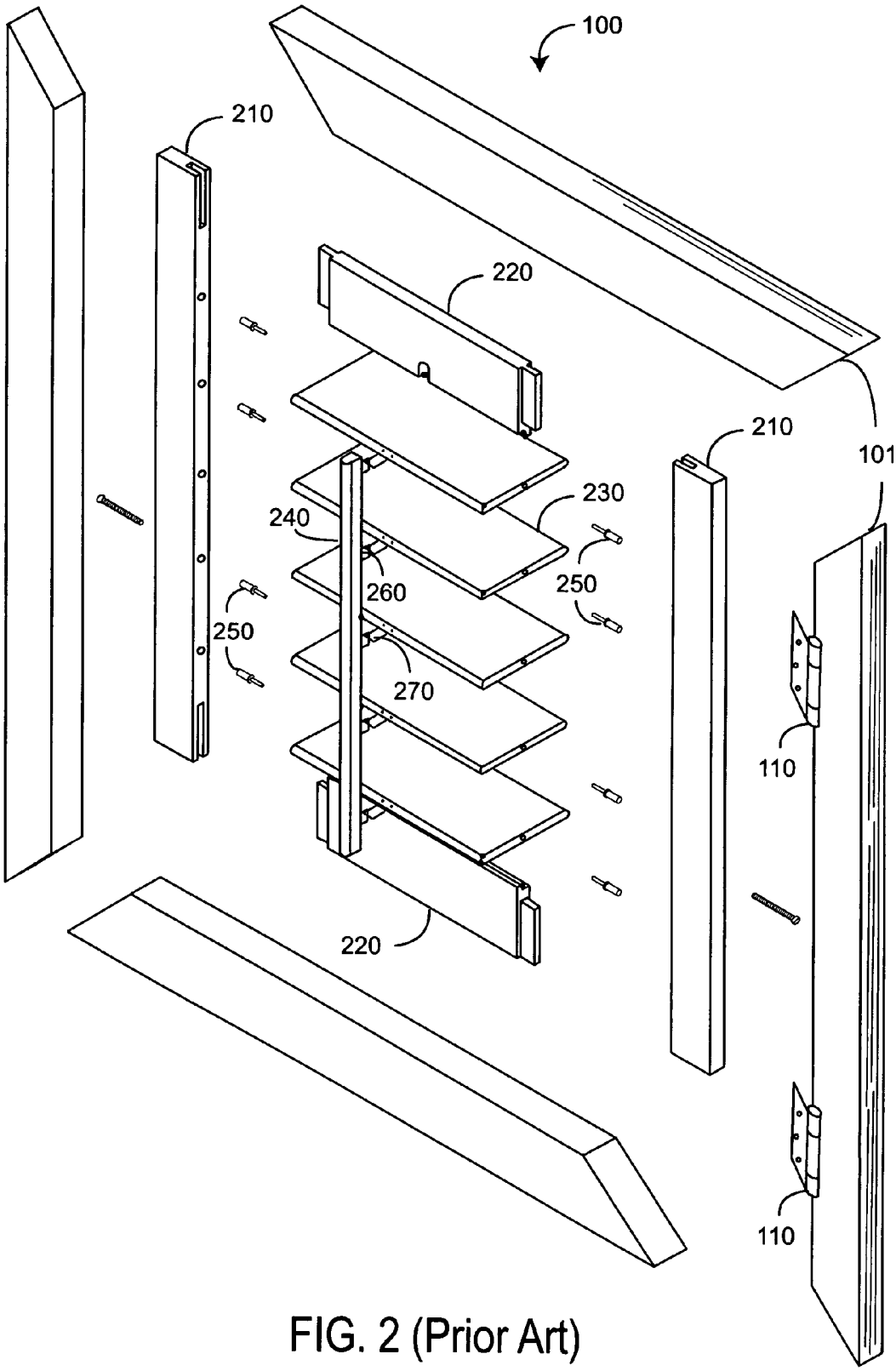
FIG. 2 (Prior Art)

FIGS. 16A-C illustrate a louver 1600, which is a generally planar shutter component having louver faces 1610, louver ends 1620 and louver edges 1630. Multiple louvers 1600 are removably snapped into corresponding unspaced louver clips 1300 (FIGS. 13A-C) and/or spaced louver clips 1400 (FIGS. 14A-C) and extend parallel between frame components 1000 (FIGS. 10A-D). Advantageously, the louvers 1600 can be made substantially thinner than conventional louvers, which must accommodate a louver pin 250 (FIG. 2). This allows more light to pass through an open shutter. In one embodiment, the louvers are manufactured at a thickness of less than ⅜ inch.

Figure 17:
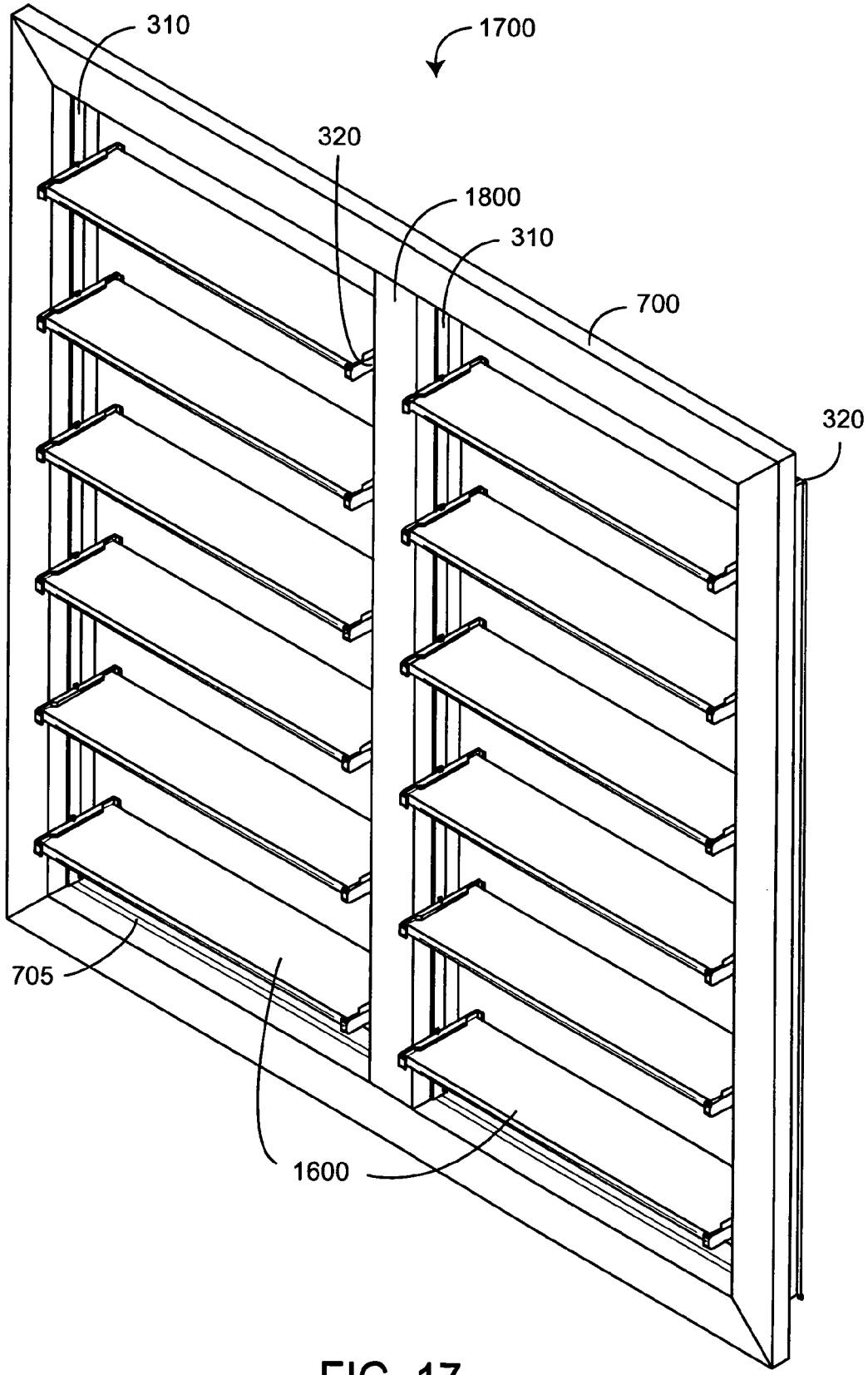
FIG. 17 is a front perspective view of a multiple section full view shutter.

FIG. 17 illustrates a multiple section shutter 1700 having a frame 700, trees 310, 320 and louvers 1600 as described above with respect to FIGS. 8A-C. The multiple section shutter 1700, however, has a center post 1800 that advantageously allows a single full view shutter to be placed within a wide window, typically greater than 4' in length. Otherwise the shutter would have excessively long louvers prone to bowing and warping. The frame 700 is constructed around the center post 1800, described with respect to FIGS. 18A-C, below, which fits within the frame groove 705. The center post 1800 can be held in place by the installed louvers 1600 or fixedly attached to the frame with Hoffman keys or other fastener or adhesive.

Figure 18A:
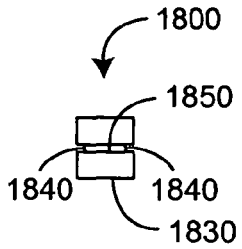
FIG. 18A-C are top, front and side views, respectively, of a center post.
Figure 18B:
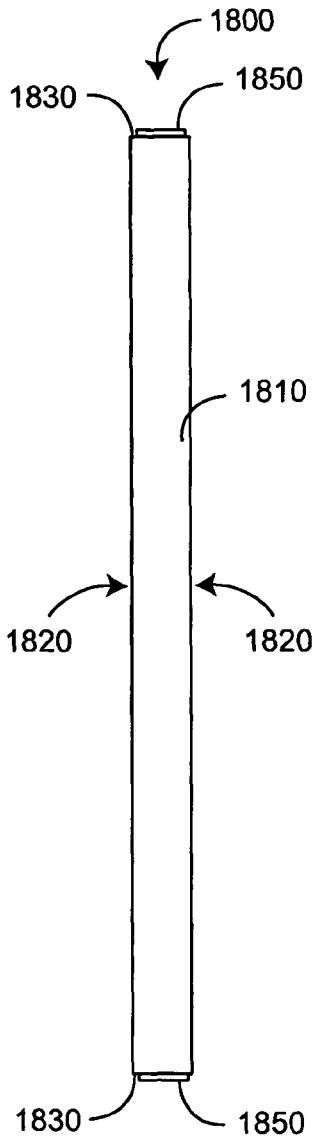
Figure 18C:
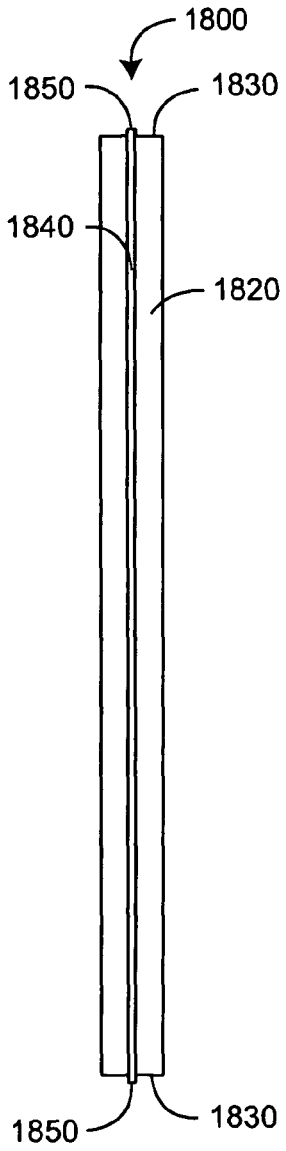
Figure 19A:
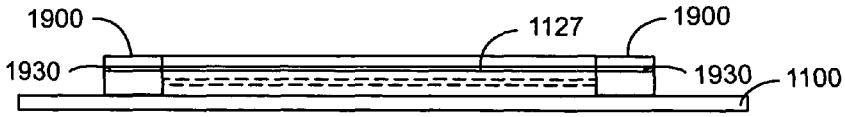
FIGS. 19A-F are top, front, side, detailed, and exploded views of a spacer block and a detailed view of ganged spacer blocks, respectively.
Figure 19B:
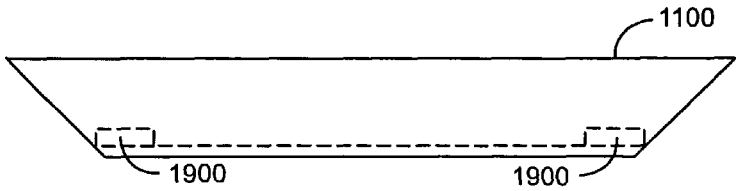
Figure 19C:
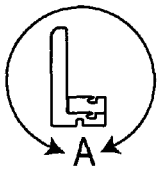
Figure 19D:
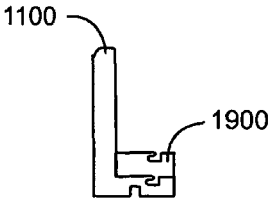
Figure 19E:
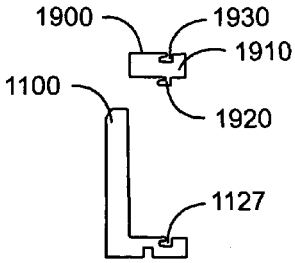
Figure 19F:
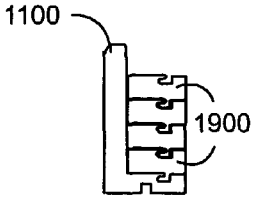

FIG. 18A-C illustrate a center post 1800, which is a generally elongated multiple section shutter 1700 component having a front 1810, sides 1820, ends 1830, post grooves 1840 extending the length of each of the sides 1820 and post tongues 1850 extending generally perpendicularly from the ends 1830. The center post 1800 is configured to be enclosed by the frame 700 (FIG. 17) during frame assembly for the multiple section shutter 1700 (FIG. 17), described above. In particular, the post tongues 1850 fit within the frame groove 705 at parallel sections of the frame 700. The post grooves 1840 are configured for tree installation in a manner similar to that described for the frame groove 705 (FIGS. 8B-C), above.

In an advantageous embodiment, the frame components and louvers are selected from frame component sets and louver sets each having various standard or predetermined lengths. The selected lengths are based upon window measurements so that a standardized frame and corresponding louvers best fit the dimensions of a particular window. In this manner, cutting frame components and louvers to size is reduced or eliminated without requiring an excessive number of stock keeping units (SKUs).

FIGS. 19A-F illustrate a spacer 1900 having a generally block-shaped body 1910, a spacer tongue 1920 and a spacer groove 1930. One or more spacers 1900 are advantageously utilized to fill a gap between a frame support 720 and the sides of a window opening. An end user utilizes the spacer 1900 to size a standardized frame to a particular window. The spacer tongue 1920 is configured to interlock with a spacer groove 1127, 1930 on either a frame component 1100 (FIGS. 11A-D) or another spacer 1900. In this manner, one or more spacers 1900 can be used to fill various size gaps. One or more spacers 1900 may be placed along the bottom, sides and/or top of a frame 700 so as to stabilize and center a frame 700 within a window opening. In one embodiment, the frame components 1100 (FIGS. 11A-D) and louvers 1600 (FIGS. 16A-C) are provided in sets of predetermined lengths to best fit window dimensions, either height or width, of 4', 4½', 5', 5½', 6', 6½', etc., and spacers 1900 are provided in ½" thicknesses and utilized to fit window dimensions in between these ½" spacings.

Figure 20A:
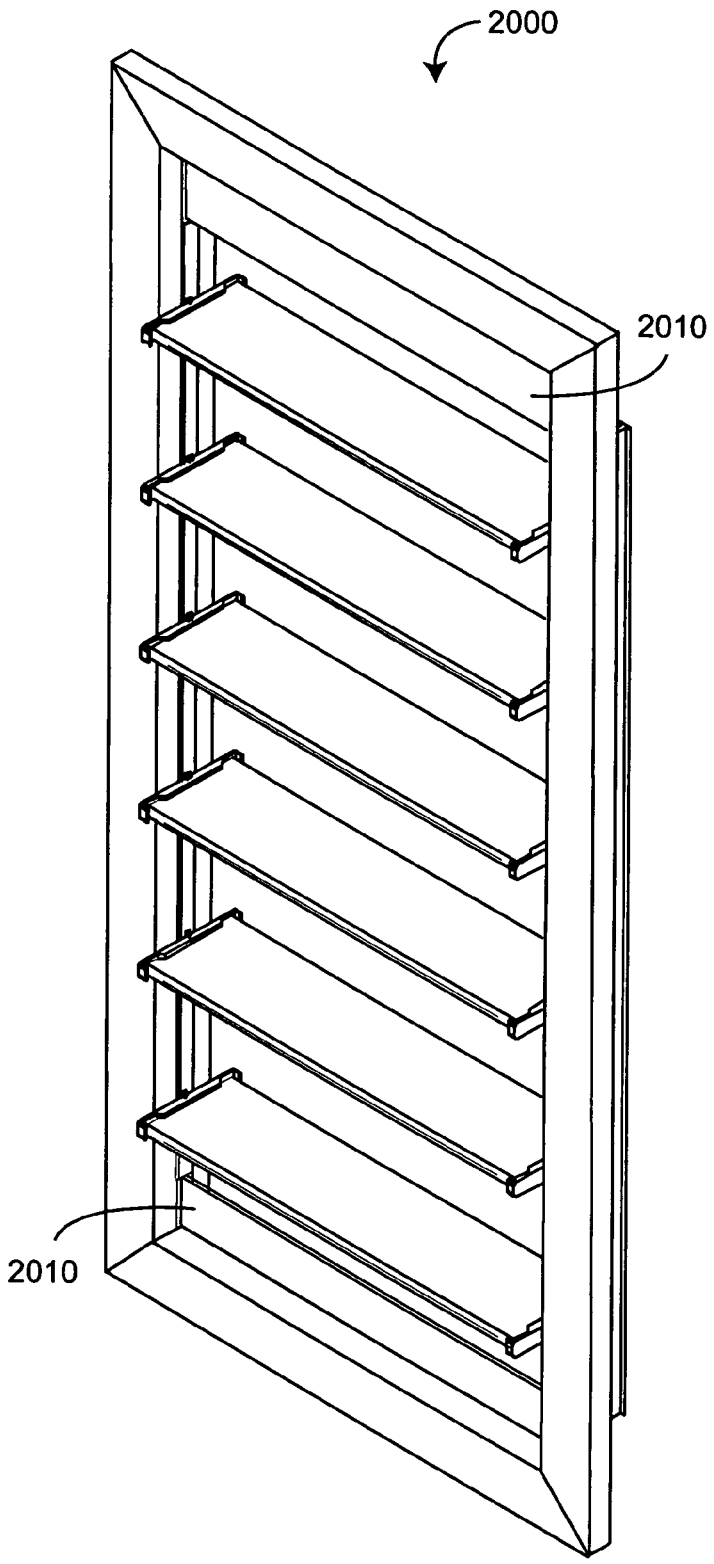
FIGS. 20A-B are front perspective and exploded front perspective views, respectively, of a full view shutter incorporating floating light blocks.
Figure 20B:
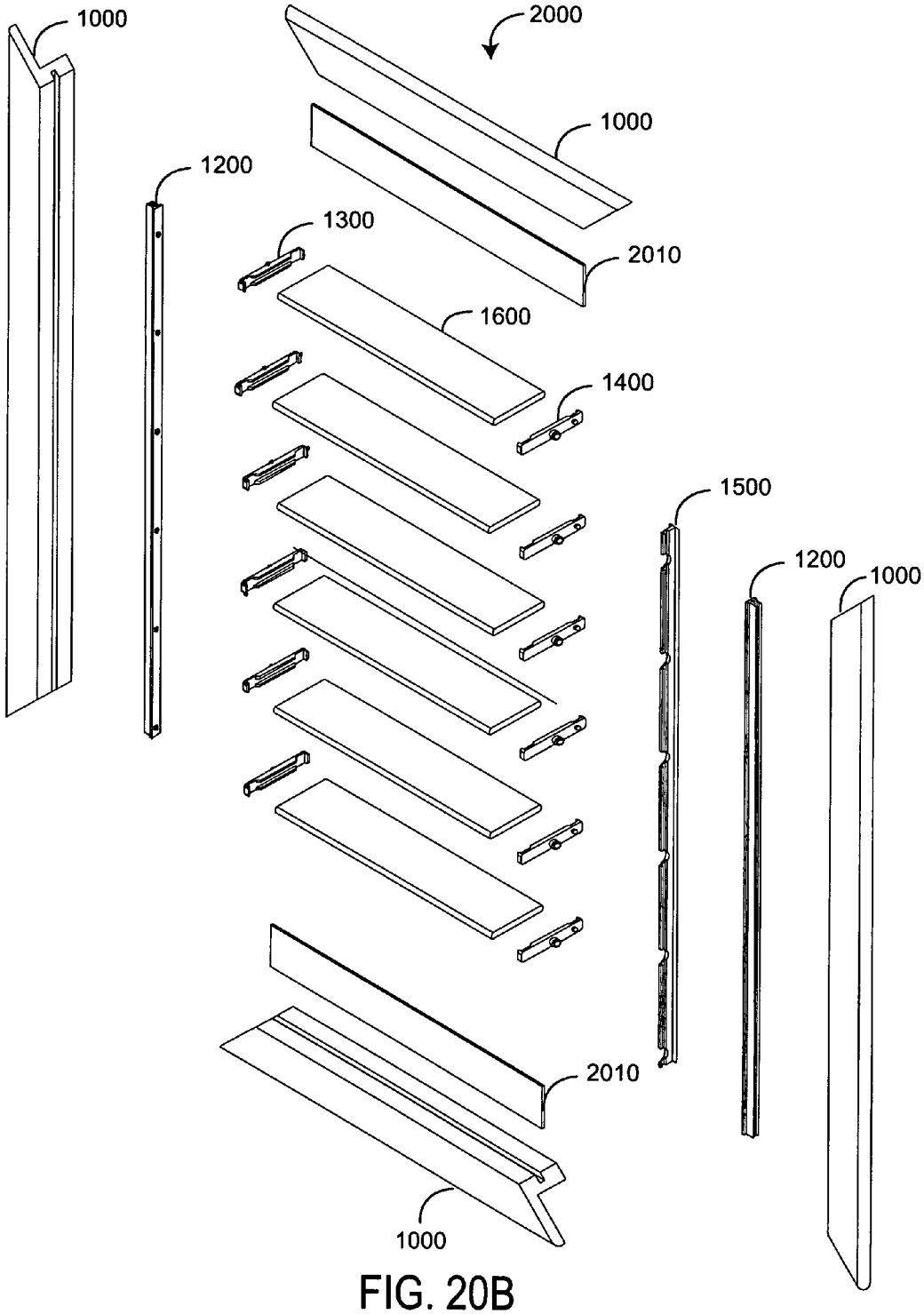

FIGS. 20A-B illustrate a light block shutter 2000 having frame components 1000, inserts 1200, clips 1300, 1400, a tilt bar 1500 and louvers 1600 as described with respect to FIGS. 3A-C, above. Further, the light block shutter 2000 has floating light blocks 2010 configured to fit within the frame groove 705 (FIGS. 7A-B). The light blocks 2010 are held in place at the top and bottom of the frame by the inserts 1200. In particular, the inserts 1200 are sized to fit between the top and bottom light blocks 2010 within the grooves of the vertical frame components 1000. Further, the light blocks 2010 are made substantially thinner than the width of the groove so that the light blocks "floats" within the groove, i.e. the light blocks can easily shift and/or tilt within the groove toward either the front or the back of the shutter. Advantageously, this floating light block feature allows the shutter to completely shut regardless of whether the louvers are closed in an upward or downward slanting direction. In contrast, prior art shutters can only close in one direction. The floating light blocks 2010 combined with the light block tilt bar 1500 provide a light block shutter 2000 with the ability to more effectively shut out light from entering a room. In one embodiment, a paper finish applied to the frame components 1000, which is slit the length of the groove, advantageously acts as a gasket that holds the floating light blocks 2010 in place unless pressed upon by adjacent louvers.

Light Stop Shutter

Figure 21A:
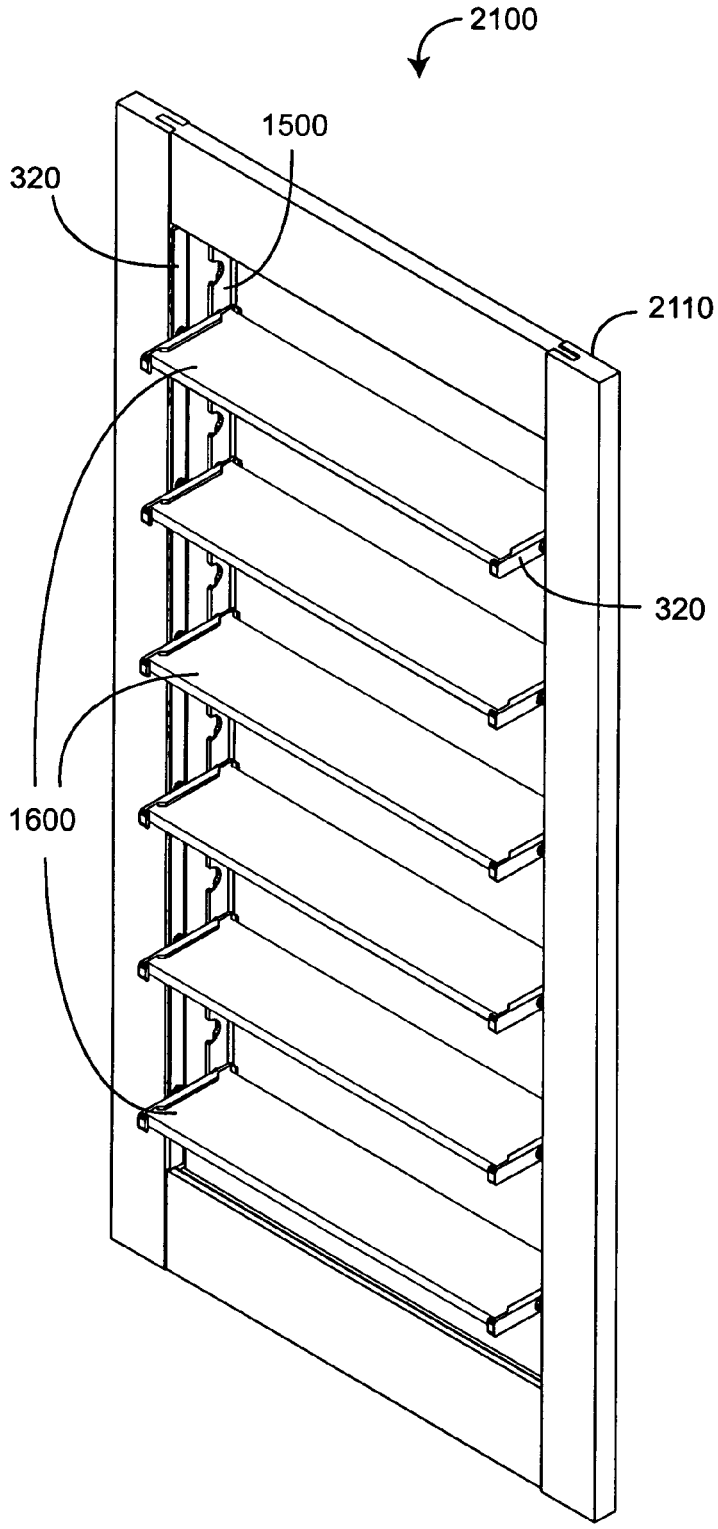
FIGS. 21A-B are front perspective views of light stop shutter embodiments.
Figure 21B:
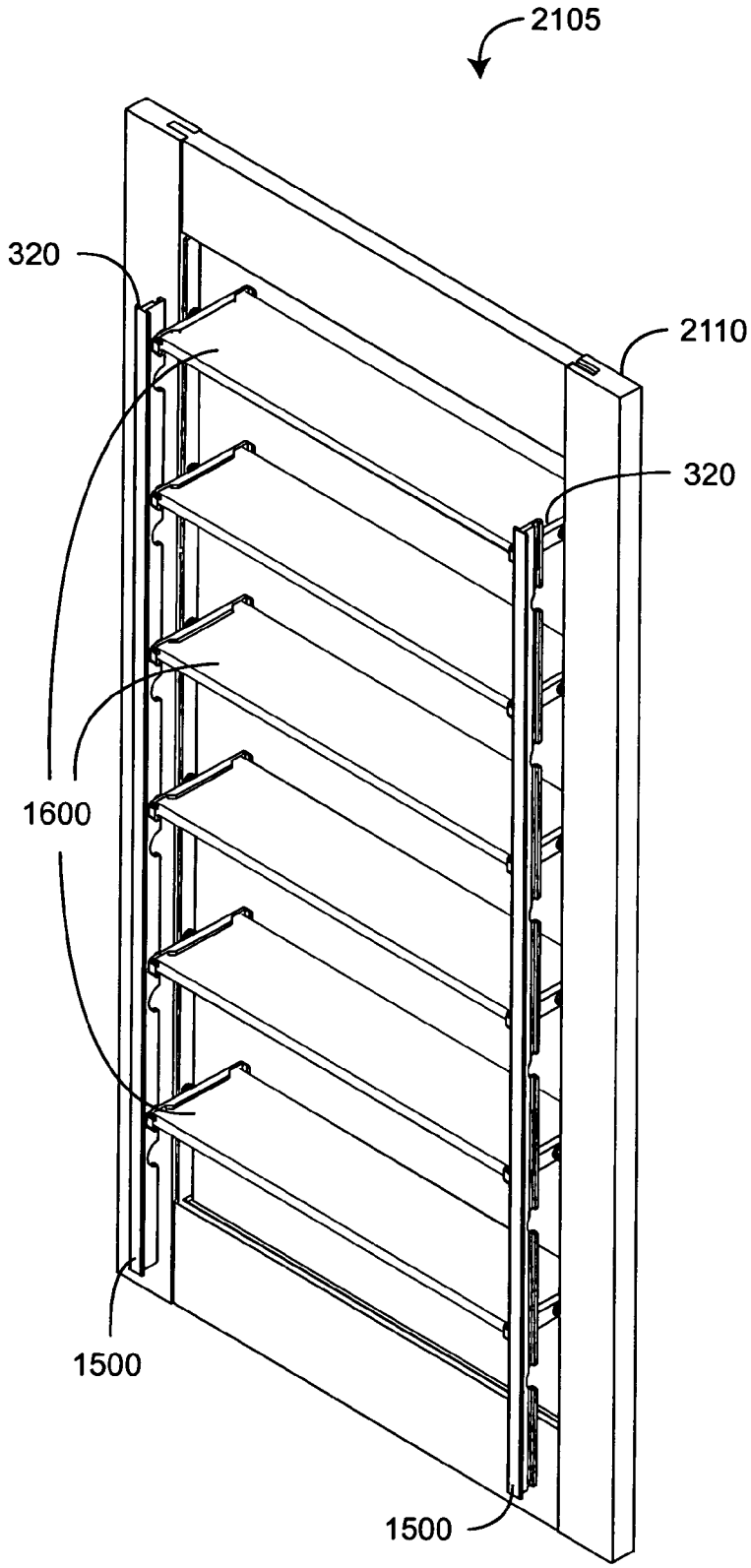

FIGS. 21A-B illustrate shutter embodiments 2100, 2105 that have easy assembly features supporting a ready to assemble (RTA) kit that substantially reduces the lead-time and expense of factory assembled and professionally installed shutters. The light stop shutter embodiments 2100, 2150 have frame components 2310, 2320 (FIG. 23) configured to assemble into a shutter frame 700, as described in detail with respect to FIGS. 23-24, below. Trees 320, as described above, are adapted to be inserted into the shutter frame 2110. Louvers 1600, as described above, are adapted to be removably attached to the trees.

As shown in FIGS. 21A-B, there are no louver-mounted tilt bars to block the view through the shutters 2100, 2105. Instead, louvers 1600 are opened and closed by moving an individual louver 1600, which moves all the louvers 1600 via light stop tilt bars 1500. Advantageously, the light stop tilt bars 1500 fit in the gap between the louvers and the frame to block light from passing through that gap when the shutters 2100, 2105 are closed. There may be a tilt bar 1500 on either side of the shutter 2100, 2105 or two tilt bars 1500, one on each side of the shutter 2100, 2105, as shown. The tilt bar or tilt bars 1500 may be located on the back of the shutter 2100 or on the front of the shutter 2105. Tilt bars on the back of the shutter 2100 are advantageously at least partially hidden. Tilt bars on the front of the shutter 2105 advantageously function as handles for opening and closing the shutters. The light stop tilt bar 1500 is described in detail with respect to FIGS. 15A-C, above.

Figure 22A:
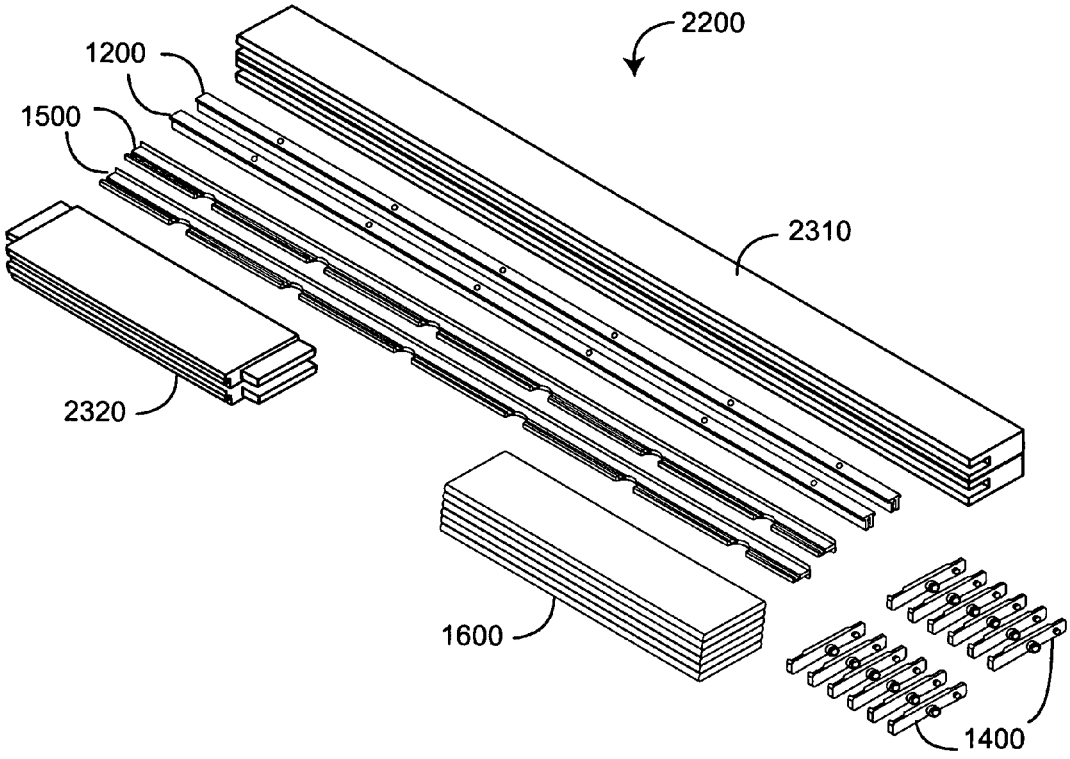
FIGS. 22A-B are perspective views of ready-to-assemble (RTA) light stop shutter kit embodiments.
Figure 22B:
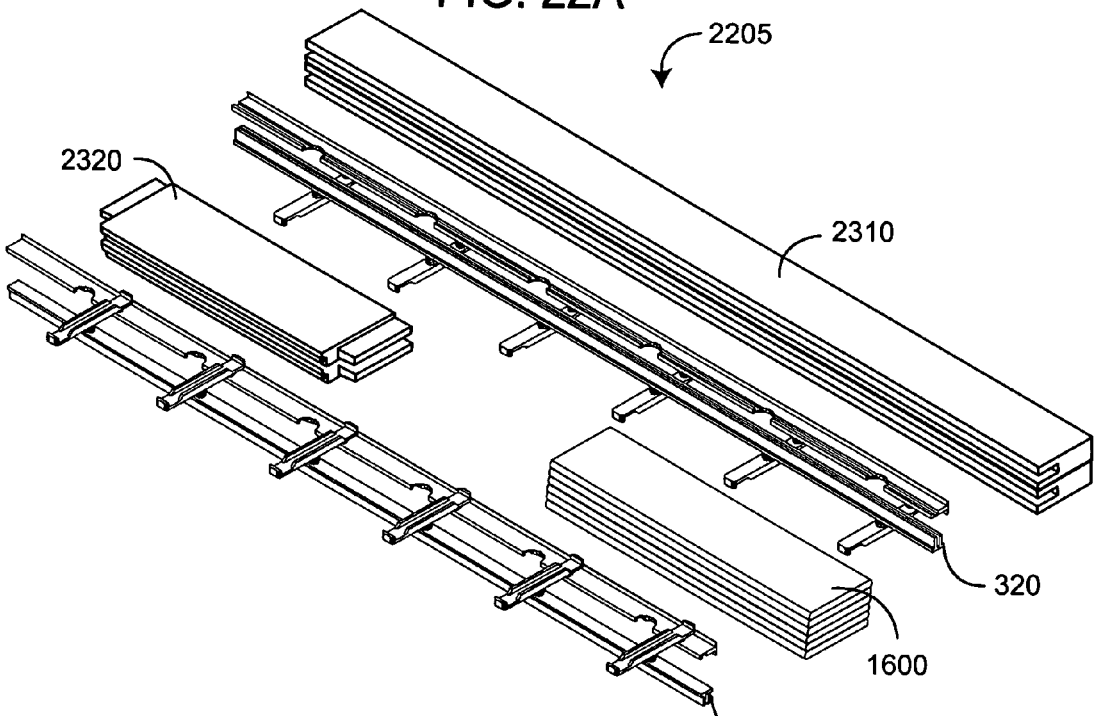

FIGS. 22A-B illustrate light stop shutter kit embodiments 2200, 2205 that may be combined, packaged, shipped and delivered as a ready-to-assemble (RTA) shutter that is easily built and installed by a layperson. Alternatively, the shutter kit components may be sold through outlets. The kit components may be cut to customer specifications or provided in standard sizes. An unassembled kit has stiles 2310, spreaders 2320, trees 320 and louvers 1600. The trees 320 may be pre-assembled (FIG. 22B) from inserts 1200, tilt bars 1500 and louver clips 1400 as described above, or distributed unassembled (FIG. 22A). In one embodiment of the RTA kit, the trees 320 are pre-installed into the stiles 2310, e.g. inserted into the stiles and held in place with tape or a similar temporary fastener. In one embodiment, the stiles 2310, spreaders 2320 and louvers 1600 are constructed of prefinished fiberboard and the inserts 1200, tilt bars 1500 and louver clips 1300, 1400 are constructed of plastic, as described in U.S. Pat. No. 6,622,433 cited above.

Figure 23:
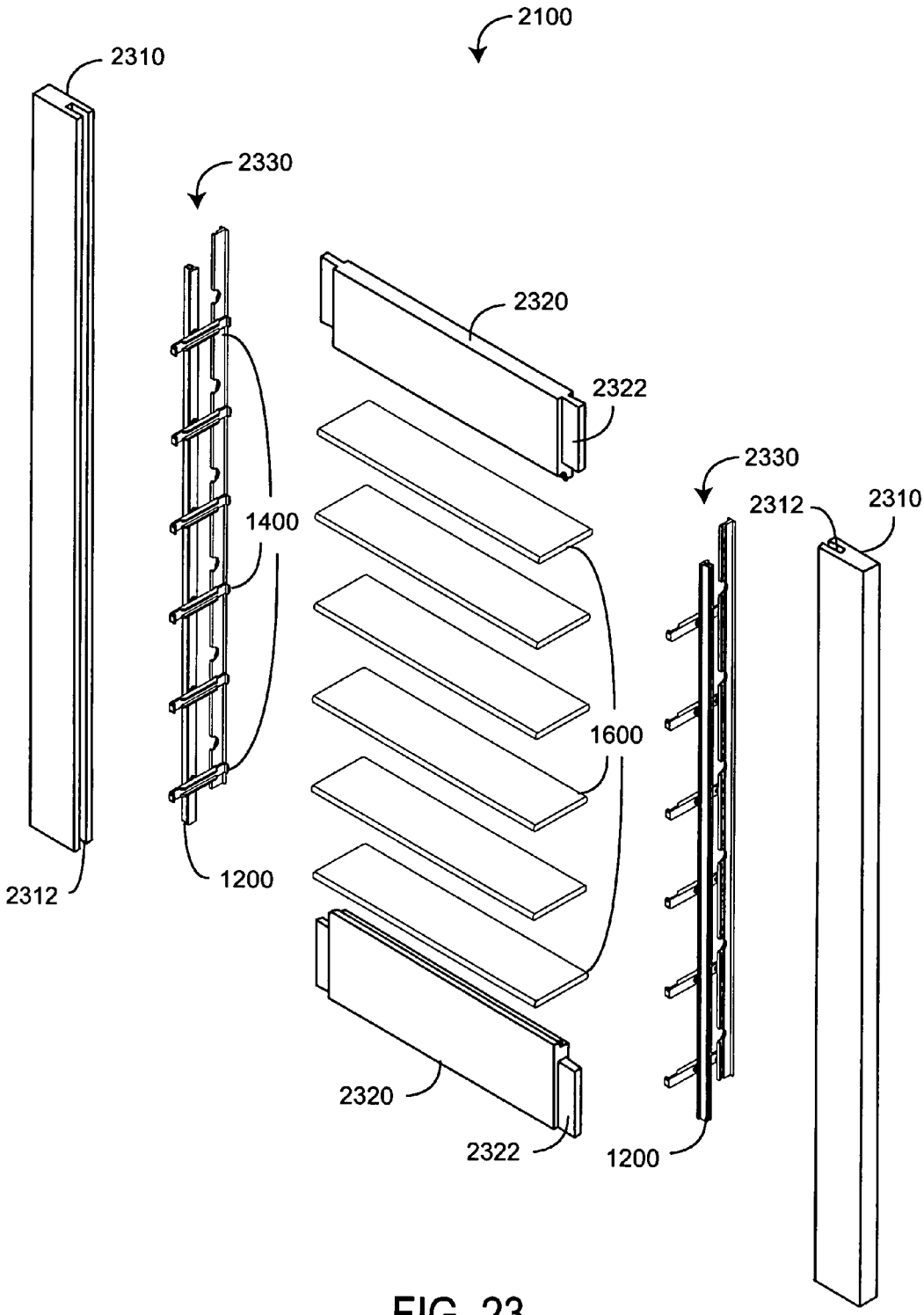
FIG. 23 is an exploded front perspective view of a light stop shutter illustrating assembly.
Figure 24:
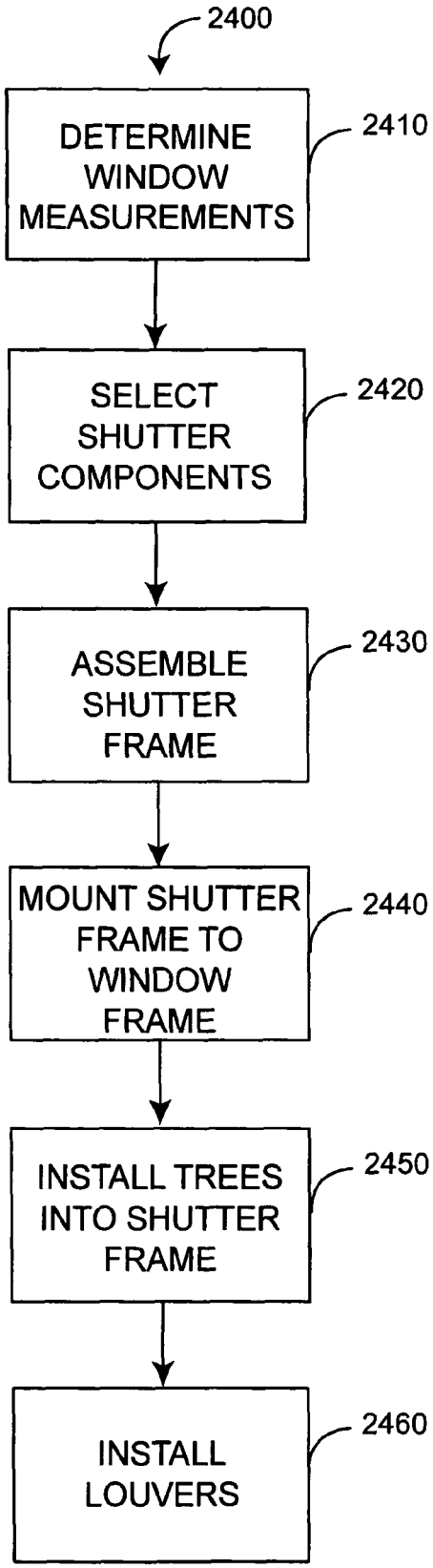
FIG. 24 is a flow diagram of a light stop shutter assembly and installation process.

FIGS. 23-24 illustrate RTA shutter kit assembly. As shown in FIG. 24, window measurements are determined 2410. In one embodiment, the shutter components are provided in standard sized sets and shutter components are selected based upon these measurements 2420. In another embodiment, the shutter components are cut to a specified length. The shutter frame is then assembled 2430. In particular, as shown in FIG. 23, the spreaders 2320 are fixedly attached to the stiles 2310 so that spreader tongues 2322 are inserted into stile grooves 2312. The stiles and spreaders are held in place with glue and/or mechanical fasteners.

Figure 1:
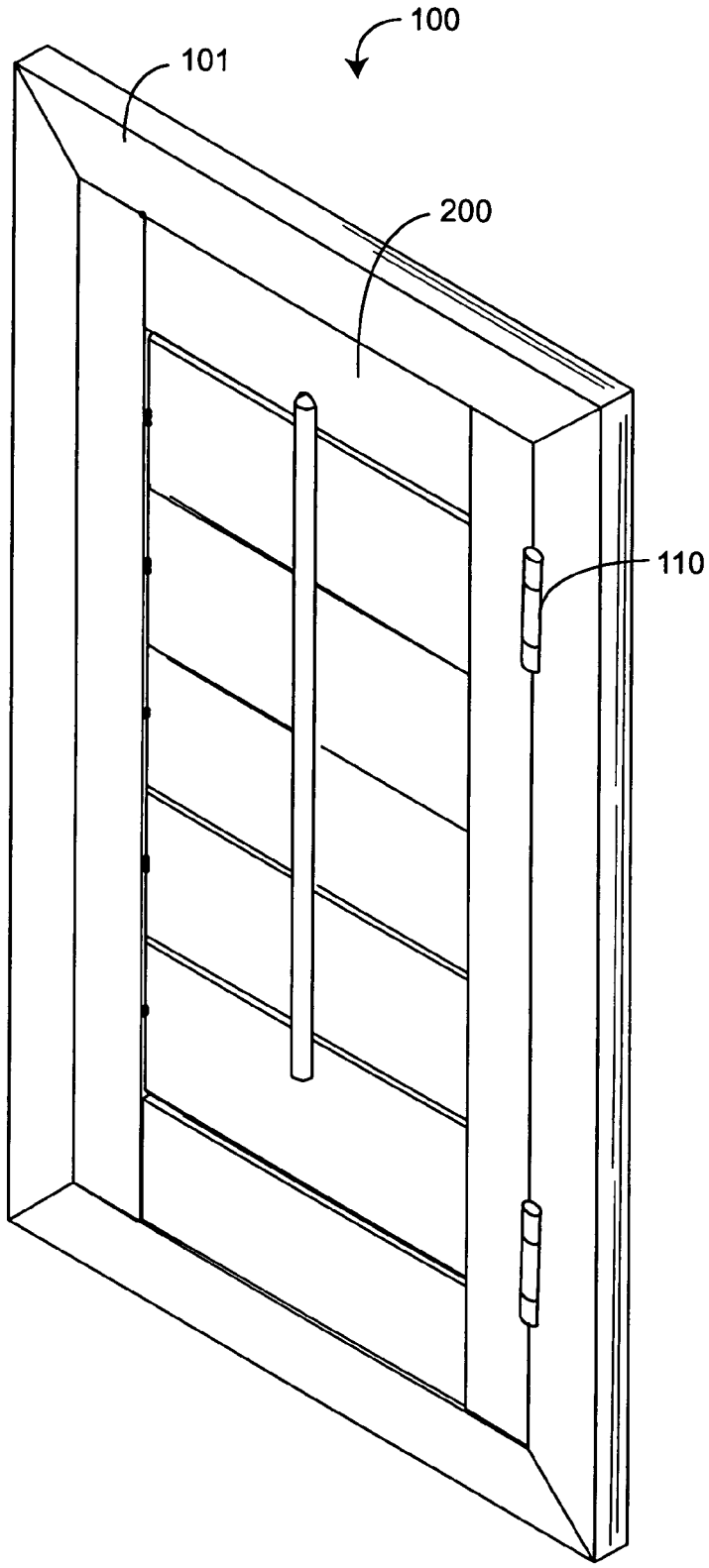
FIG. 1 (Prior Art)
FIGS. 1-2 are front perspective and exploded front perspective views, respectively, of a conventional shutter and window frame.

Further shown in FIG. 24, the assembled shutter frame is mounted to a conventional window frame 101 (FIGS. 1-2). The window frame components may be included in the RTA light stop shutter kit or provided separately. In a particular embodiment, the shutter frame may have predrilled holes for screws or similar fasteners to attach hinges 110 (FIG. 2) to the shutter frame.

Also shown in FIG. 24, trees are installed into the frame 2450. In particular, as shown in FIG. 23, the tree inserts 1200 are inserted into the stile grooves 2312. The trees may be provided in a general length and cut or otherwise trimmed to size for a specific frame or may be provided in standard sizes or pre-cut to size. The shutter assembly is completed by installing the louvers 2460 (FIG. 24). In particular, the ends of the louvers 1600 (FIG. 23) are removably attached to the louver clips 1400 (FIG. 23).

A ready-to-assemble (RTA) shutter has been disclosed and described above in detail in connection with various embodiments, including a full view shutter and a light stop shutter. These embodiments are disclosed by way of examples only and are not to limit the scope of the claims that follow. One of ordinary skill in art will appreciate many variations and modifications.

What is claimed is:

1. A shutter kit method comprising the steps of:

providing a plurality of frame components configured to assemble into a frame;

providing a plurality of louvers; and assembling a plurality of trees adapted to attach to said frame, said trees capable of removably and rotatably disposing said louvers within an opening of said frame; and combining said frame components, trees and louvers as a ready-to-assemble shutter.

2. The shutter kit method according to claim 1 wherein said assembling step comprises the substeps of:

providing a plurality of inserts adapted to insert into stiles of said frame components;

rotatably attaching a plurality of louver clips at regular intervals along the length of said inserts; and interconnecting at least a portion of said louver clips with at least one of a plurality of tilt bars.

3. The shutter kit method according to claim 2 wherein said interconnecting substep comprises the substeps of:

configuring leg portions of said tilt bars to fit into gaps between said frame and said louvers; and configuring cross bar portions of said tilt bars to fit across said gaps so as to block light from passing through said gaps.

4. The shutter kit method according to claim 3 comprising the further steps of:

determining a plurality of window measurements;

selecting said frame components and said louvers, based upon said window measurements, from a frame component set and a louver set, wherein said frame component set comprises a plurality of predetermined length stiles and a plurality of predetermined length spreaders, and wherein said louver set comprises a plurality of predetermined length louvers.

5. The shutter kit method according to claim 4 comprising the further step of trimming said trees to a specific length based on at least one of said window measurements.

6. The shutter kit method according to claim 5 comprising the further step of pre-inserting said trees into said stiles.

7. A shutter kit comprising:

a plurality of frame components configured to assemble into a shutter frame;

a plurality of louvers adapted to fit within said shutter frame;

a plurality of inserts adapted to attach to stiles of said frame components;

a plurality of louver clips capable of rotatably attaching at regular intervals along the length of said inserts and removably retaining said louvers; and a plurality of tilt bars adapted to rotatably interconnect said louver clips, wherein said frame components, louvers, inserts, louver clips and tilt bars are combined as a ready-to-assemble shutter; and wherein said inserts, louver clips and tilt bars are preassembled into a plurality of trees, said trees adapted to insert into an assembled shutter frame.

8. The shutter kit according to claim 7 further comprising light stop portions of said tilt bars adapted to block light between said assembled shutter frame and said louvers when said louvers are in a closed position.

9. The shutter kit according to claim 8 wherein said frame components and louvers are each selected from a set of frame components and louvers having a plurality of predetermined lengths.

10. The shutter according to claim 9 wherein said trees are adapted to be cut to a length corresponding to said assembled shutter frame.

11. The shutter according to claim 10 wherein said trees are pre-inserted into stiles of said frame components.

* * * * *